US010634172B2

(12) United States Patent
Fujiwara

(10) Patent No.: US 10,634,172 B2
(45) Date of Patent: Apr. 28, 2020

(54) CYLINDER OPERATION STATE MONITORING DEVICE

(71) Applicant: SMC CORPORATION, Chiyoda-ku (JP)

(72) Inventor: Atsushi Fujiwara, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 26 days.

(21) Appl. No.: 16/097,029

(22) PCT Filed: Apr. 7, 2017

(86) PCT No.: PCT/JP2017/014510
§ 371 (c)(1),
(2) Date: Oct. 26, 2018

(87) PCT Pub. No.: WO2017/187934
PCT Pub. Date: Nov. 2, 2017

(65) Prior Publication Data

US 2019/0145437 A1 May 16, 2019

(30) Foreign Application Priority Data

Apr. 27, 2016 (JP) ..... 2016-089003

(51) Int. Cl.
*F15B 15/28* (2006.01)
*F15B 20/00* (2006.01)
*F15B 11/10* (2006.01)

(52) U.S. Cl.
CPC ..... *F15B 15/28* (2013.01); *F15B 11/10* (2013.01); *F15B 20/00* (2013.01); *F15B 2211/7054* (2013.01); *F15B 2211/857* (2013.01)

(58) Field of Classification Search
CPC ..... F15B 15/2838; F15B 19/005; F15B 2211/6313; F15B 11/10
See application file for complete search history.

(56) References Cited

U.S. PATENT DOCUMENTS 7,353,743 B2 * 4/2008 Bugel ..... F15B 9/09 91/392
7,387,061 B2 * 6/2008 Kobata ..... F15B 11/048 60/461

(Continued)

FOREIGN PATENT DOCUMENTS

JP 56-39850 A 4/1981
JP 7-182049 A 7/1995

(Continued)

OTHER PUBLICATIONS

International Search Report dated May 23, 2017 in PCT/JP2017/014510 filed Apr. 7, 2017.

(Continued)

*Primary Examiner* — Thomas E Lazo
(74) *Attorney, Agent, or Firm* — Oblon, McClelland, Maier & Neustadt, L.L.P.

(57) ABSTRACT

A monitoring device includes a first pressure sensor that detects a first pressure value of a pressurized fluid in a first pipe, a second pressure sensor that detects a second pressure value of a pressurized fluid in a second pipe, and a detector that determines, on the basis of the first pressure value and the second pressure value, whether or not a piston has reached one end or the other inside a cylinder body.

12 Claims, 18 Drawing Sheets

(56) References Cited

U.S. PATENT DOCUMENTS

| | | | | |
|---|---|---|---|---|
| 7,827,787 | B2 * | 11/2010 | Cherney | E02F 9/2203 60/414 |
| 10,072,676 | B2 * | 9/2018 | Afshari | F15B 7/006 |
| 10,385,890 | B2 * | 8/2019 | Batenburg | F15B 15/2815 |
| 2003/0187595 | A1 | 10/2003 | Koshinaka et al. | |
| 2004/0261608 | A1 * | 12/2004 | Bugel | F15B 9/09 91/465 |
| 2007/0209503 | A1 * | 9/2007 | Pfaff | F15B 11/006 91/433 |
| 2012/0131912 | A1 * | 5/2012 | Fukui | B64C 13/42 60/405 |
| 2015/0007713 | A1 * | 1/2015 | Aki | G01M 13/00 91/1 |
| 2015/0354172 | A1 * | 12/2015 | Hijikata | F15B 11/024 60/414 |
| 2016/0298659 | A1 | 10/2016 | Batenburg et al. | |
| 2018/0266415 | A1 * | 9/2018 | Afshari | F15B 7/006 |

FOREIGN PATENT DOCUMENTS

| | | | |
|---|---|---|---|
| JP | 2003-71600 | A | 3/2003 |
| JP | 2003-294503 | A | 10/2003 |
| JP | 3857187 | B2 | 12/2006 |
| JP | 2010-71349 | A | 4/2010 |
| JP | 2010-159783 | A | 7/2010 |
| JP | 5331986 | B2 | 10/2013 |
| JP | 2015-14990 | A | 1/2015 |

OTHER PUBLICATIONS

Third Party Observation dated Aug. 27, 2018 in PCT/JP2017/014510 filed Apr. 7, 2017.

U.S. Appl. No. 15/722,647, filed Oct. 2, 2017, US 2018-0094655 A1, Fujiwara, A.

U.S. Appl. No. 15/722,693, filed Oct. 2, 2017, US 2018-0094654 A1, Fujiwara, A.

* cited by examiner

CYLINDER OPERATION STATE MONITORING DEVICE

TECHNICAL FIELD

The present invention relates to a cylinder operation state monitoring device having a cylinder body, a piston capable of moving reciprocally between one end and another end inside the cylinder body, and a piston rod integrally connected to the piston.

BACKGROUND ART

A cylinder includes a cylinder body, a piston that moves reciprocally between one end and another end inside the cylinder body, and a piston rod integrally connected to the piston. A first cylinder chamber is formed between the one end and the piston inside the cylinder body, and a second cylinder chamber is formed between the other end and the piston inside the cylinder body. In this instance, by supplying fluid from a fluid supply source to the first cylinder chamber via a first tube, or by supplying fluid to the second cylinder chamber via a second tube, the piston and the piston rod are capable of moving reciprocally between the one end and the other end inside the cylinder body.

Incidentally, by installing proximity sensors in the vicinity of the cylinder, detection of the arrival of the piston at the one end or the other end inside the cylinder body has conventionally been carried out. For example, in the case that limit sensors are installed as such proximity sensors, at a time that a distal end of the piston rod, which protrudes outside of the cylinder body, and the limit sensors come into mechanical contact, contact points in the interior of the limit sensors are switched, and detection signals indicating arrival of the piston are output from the limit sensors. Further, in Japanese Patent No. 3857187, it is disclosed to incorporate a magnet in a piston rod, and position detecting sensors which detect magnetism of the magnet are provided at the one end and the other end of the cylinder body.

SUMMARY OF INVENTION

However, in the conventional technique in which limit sensors are used, since the arrival of the piston is detected by mechanical contact between the piston rod and the limit sensors, there is a problem in that it is necessary to take into consideration the service life, etc., of the contact points.

On the other hand, in the technique of Japanese Patent No. 3857187, since the detection method does not use mechanical contact, there is no concern about the service life, etc., of contact points. However, for example, in the case that a cylinder is used in connection with equipment related to foods, if the cylinder is showered with cleaning liquid applied with respect to the foods, there is a possibility that the position detecting sensors and wiring for the position detecting sensors may become corroded. Thus, costs are incurred if an attempt is made to ensure liquid resistance of the position detecting sensors and the wiring therefor.

In this manner, conventionally, in order to detect whether or not a piston has reached the one end or the other end inside the cylinder body, the aforementioned problem occurs because sensors are installed in the vicinity of the cylinder.

The present invention has been devised in order to solve the aforementioned problem, and an object of the present invention is to provide a cylinder operation state monitoring device, which is capable of detecting the arrival of a piston at the one end or the other end inside a cylinder body, without installing sensors in the vicinity of the cylinder.

The present invention relates to an operation state monitoring device for a cylinder in which a piston connected to a piston rod is reciprocally moved between one end and another end inside a cylinder body, by a first cylinder chamber being formed between the one end and the piston inside the cylinder body, together with a second cylinder chamber being formed between the other end and the piston inside the cylinder body, and by a fluid being supplied from a fluid supply source to the first cylinder chamber via a first tube, or the fluid being supplied from the fluid supply source to the second cylinder chamber via a second tube.

In addition, in order to achieve the aforementioned object, the operation state monitoring device for the cylinder according to the present invention includes a first pressure detecting unit configured to detect a pressure of the fluid inside the first tube, a second pressure detecting unit configured to detect a pressure of the fluid inside the second tube, and a determination unit configured to determine whether or not the piston has reached the one end or the other end inside the cylinder body, on a basis of the respective pressures detected by the first pressure detecting unit and the second pressure detecting unit.

In the cylinder, by supplying fluid from the fluid supply source to the first cylinder chamber or the second cylinder chamber via the first tube or the second tube, the piston and the piston rod are moved reciprocally between the one end and the other end inside the cylinder body. More specifically, the piston and the piston rod undergo reciprocal movement in accordance with a change (increase or decrease) in the pressures of the first cylinder chamber and the second cylinder chamber in accordance with a supplying operation of the fluid.

In this case, when the piston has reached the one end inside the cylinder body, the fluid in the first cylinder chamber is discharged to the exterior, whereas the pressure in the second cylinder chamber becomes the pressure of the fluid that is supplied via the second tube. Further, when the piston has reached the other end inside the cylinder body, the pressure in the first cylinder chamber becomes the pressure of the fluid that is supplied via the first tube, whereas the fluid in the second cylinder chamber is discharged to the exterior.

In addition, the pressure of the fluid inside the first tube corresponding to the pressure of the first cylinder chamber is detected by the first pressure detecting unit, while on the other hand, the pressure of the fluid inside the second tube corresponding to the pressure of the second cylinder chamber is detected by the second pressure detecting unit. Accordingly, the pressure of the fluid inside the first tube and the pressure of the fluid inside the second tube can be easily monitored.

Thus, according to the present invention, on the basis of the pressure of the fluid inside the first tube as detected by the first pressure detecting unit, and the pressure of the fluid inside the second tube as detected by the second pressure detecting unit, it is determined whether or not the piston has reached the one end or the other end inside the cylinder body.

Consequently, without installing a sensor in the vicinity of the cylinder, it is possible to detect the arrival of the piston at the one end or the other end inside the cylinder body. Further, because there is no need to install a sensor and wiring for the sensor in the vicinity of the cylinder, there is no occurrence of problems such as corrosion of the sensor and wiring therefor in a cleaning process used in connection with food related equipment. As a result, the cylinder can be suitably used in connection with food related equipment.

In this instance, the determination unit may be configured to determine whether or not the piston has reached the one end or the other end inside the cylinder body, on a basis of a differential pressure between a first pressure value which is a pressure value of the fluid inside the first tube detected by the first pressure detecting unit, and a second pressure value which is a pressure value of the fluid inside the second tube detected by the second pressure detecting unit.

In the case that the piston moves reciprocally between the one end and the other end inside the cylinder body, the differential pressure maintains a substantially constant value. Additionally, when the piston reaches the one end or the other end inside the cylinder body, since the pressure in one of the chambers from among the first cylinder chamber and the second cylinder chamber becomes the pressure of the supplied fluid, whereas the pressure in the other chamber drops to substantially zero, the differential pressure increases abruptly. Thus, by grasping such a change in the differential pressure, the determination unit is capable of easily detecting the arrival of the piston at the one end or the other end inside the cylinder body.

In this case, on a basis of the differential pressure between the first pressure value and the second pressure value, and a sign of the differential pressure, the determination unit may be configured to determine which of the one end and the other end inside the cylinder body that the piston has reached. Consequently, by grasping an abrupt increase in the differential pressure, it is possible to determine whether the piston has reached the one end or the other end inside the cylinder body, and together therewith, by specifying the sign (positive or negative) of the differential pressure at that time, It is possible to recognize which of the one end or the other end inside the cylinder body that the piston has reached.

Specific determination methods (first to fifth determination methods) carried out in the determination unit will be described below.

As a first determination method, the determination unit is configured to determine that the piston has reached the other end inside the cylinder body, when a first differential pressure, which is obtained by subtracting the second pressure value from the first pressure value, exceeds a first reference differential pressure. Further, the determination unit is configured to determine that the piston has reached the one end inside the cylinder body, when a second differential pressure, which is obtained by subtracting the first pressure value from the second pressure value, exceeds a second reference differential pressure. Furthermore, the determination unit is configured to determine that the piston is between the one end and the other end inside the cylinder body, in a case that the first differential pressure is less than or equal to the first reference differential pressure, and the second differential pressure is less than or equal to the second reference differential pressure.

In accordance with this feature, the arrival of the piston at the one end or the other end inside the cylinder body can be easily determined based only on the first differential pressure and the second differential pressure.

Further, in the first determination method, the first pressure detecting unit may be configured to output to the determination unit a first pressure signal corresponding to the first pressure value, and the second pressure detecting unit may be configured to output to the determination unit a second pressure signal corresponding to the second pressure value. In this case, the determination unit includes a comparison circuit, is configured to adjust a reference voltage in accordance with the first reference differential pressure or the second reference differential pressure, and determine whether or not the piston has reached the one end or the other end inside the cylinder body by comparing a signal level difference between the input first pressure signal and the input second pressure signal with the reference voltage.

In this manner, in the case that the determination unit is constituted by an analog circuit, by comparing a signal level difference in accordance with the first differential pressure or the second differential pressure with the reference voltage corresponding to the first reference differential pressure or the second reference differential pressure, it is possible to easily determine whether the piston has reached the one end or the other end inside the cylinder body.

Further, the operating characteristics of the cylinder (temporal change characteristics of the first pressure value and the second pressure value) differ in accordance with the operating environment of the cylinder and the type of the cylinder. Thus, by making the reference voltage adjustable, it is possible to detect the arrival of the piston at the one end or the other end inside the cylinder body while setting appropriate specifications in accordance with a user's request.

As a second determination method, the operation state monitoring device further includes a switching valve configured to switch a connection between the fluid supply source and the first tube or the second tube, and a control unit configured to drive the switching valve by supplying a command signal to the switching valve to thereby switch the connection.

In the second determination method, in a case that the fluid supply source and the first tube are connected via the switching valve, the determination unit is configured to determine that the piston has reached the other end inside the cylinder body when the first differential pressure, which is obtained by subtracting the second pressure value from the first pressure value, exceeds the first reference differential pressure. On the other hand, if the first differential pressure is less than or equal to the first reference differential pressure, the determination unit is configured to determine that the piston is between the one end and the other end inside the cylinder body.

Further, in a case that the fluid supply source and the second tube are connected via the switching valve, the determination unit is configured to determine that the piston has reached the one end inside the cylinder body when the second differential pressure, which is obtained by subtracting the first pressure value from the second pressure value, exceeds the second reference differential pressure. On the other hand, if the second differential pressure is less than or equal to the second reference differential pressure, the determination unit is configured to determine that the piston is between the one end and the other end inside the cylinder body.

By grasping to which of the first tube and the second tube the fluid supply source is connected by the switching valve, it is possible to specify the direction of movement of the piston inside the cylinder body. Thus, according to the second determination method, the movement direction of the piston inside the cylinder body is specified on the basis of the connected relationship between the fluid supply source and the first tube or the second tube by the switching valve, and concerning the specified movement direction, it is determined whether or not the piston has reached the one end or the other end inside the cylinder body on the basis of a comparison between the first differential pressure or the second differential pressure and the first reference differential pressure or the second reference differential pressure. Consequently, it is possible to efficiently and reliably detect the arrival of the piston at the one end or the other end inside the cylinder body.

As a third determination method, the operation state monitoring device further includes a time measuring unit configured to measure time from a time at which the control unit begins to supply the command signal to the switching valve.

In the third determination method, the determination unit is configured to, in a case that the first differential pressure exceeds the first reference differential pressure or the second differential pressure exceeds the second reference differential pressure, and if a measured time of the time measuring unit lies within a reference time range, determine that the piston has reached the one end or the other end inside the cylinder body. On the other hand, if the measured time deviates from the reference time range, the determination unit is configured to determine that the reciprocal motion operation of the piston and the piston rod is abnormal.

For example, in the event of an abnormal condition, such as a case in which a distal end of the piston rod collides with an obstacle, a case in which the first reference differential pressure or the second reference differential pressure undergoes a change in setting, or alternatively, a case in which fluid is leaking from the cylinder, the first tube, or the second tube, then even if the piston is located between the one end and the other end inside the cylinder body, there is a possibility that the first differential pressure or the second differential pressure will exceed the first reference differential pressure or the second reference differential pressure, and it will be erroneously detected that the piston has reached the one end or the other end. Further, in the aforementioned abnormal condition, the arrival time period of the piston at the one end or the other end inside the cylinder body may be shorter or longer in comparison with the arrival time period thereof in a normal state. Therefore, it is difficult to detect such an abnormal condition merely by comparing the first differential pressure or the second differential pressure with the first reference differential pressure or the second reference differential pressure.

Thus, according to the third determination method, if the time measured by the time measuring unit lies within the reference time range, the cylinder, etc., is in a normal state, and by the piston and the piston rod carrying out reciprocal movement in a normal manner, it is determined that the piston has reached the one end or the other end inside the cylinder body. On the other hand, if the measured time deviates from the reference time range, it is determined that the cylinder, etc., is in an abnormal state, and that the reciprocal motion of the piston and the piston rod is abnormal. Consequently, it is possible to easily detect an abnormality of the cylinder or the like, as well as an abnormality of the reciprocal movement operation of the piston and the piston rod.

As a fourth determination method, the operation state monitoring device further includes a first flow rate detecting unit configured to detect a flow rate of the fluid inside the first tube as a first flow rate, and a second flow rate detecting unit configured to detect a flow rate of the fluid inside the second tube as a second flow rate.

In the fourth determination method, in a case that the first differential pressure exceeds the first reference differential pressure, and if a first flow rate difference, which is obtained by subtracting the second flow rate from the first flow rate, is less than a first reference flow rate difference, the determination unit is configured to determine that the piston has reached the other end inside the cylinder body. On the other hand, if the first flow rate difference is greater than or equal to the first reference flow rate difference, the determination unit is configured to determine that the piston is between the one end and the other end inside the cylinder body.

Further, in a case that the second differential pressure exceeds the second reference differential pressure, and if a second flow rate difference, which is obtained by subtracting the first flow rate from the second flow rate, is less than a second reference flow rate difference, the determination unit is configured to determine that the piston has reached the one end inside the cylinder body. On the other hand, if the second flow rate difference is greater than or equal to the second reference flow rate difference, the determination unit is configured to determine that the piston is between the one end and the other end inside the cylinder body.

In this manner, in addition to the comparison between the first differential pressure or the second differential pressure and the first reference differential pressure or the second reference differential pressure, the determination unit compares the first flow rate difference or the second flow rate difference with the first reference flow rate difference or the second reference flow rate difference. Consequently, the reliability of the determination result in relation to the arrival of the piston at the one end or the other end inside the cylinder body can be improved.

As a fifth determination method, the operation state monitoring device further includes a first flow rate detecting unit configured to detect a flow rate of the fluid inside the first tube as a first flow rate, a second flow rate detecting unit configured to detect a flow rate of the fluid inside the second tube as a second flow rate, and an integral flow rate calculating unit configured to calculate a first integral flow rate by integrating the first flow rate, or to calculate a second integral flow rate by integrating the second flow rate.

In the fifth determination method, in a case that the first differential pressure exceeds the first reference differential pressure or the second differential pressure exceeds the second reference differential pressure, and if the first integral flow rate or the second integral flow rate lies within a reference flow rate range, the determination unit is configured to determine that the piston has reached the one end or the other end inside the cylinder body. On the other hand, if the first integral flow rate or the second integral flow rate deviates from the reference flow rate range, the determination unit is configured to determine that a reciprocal motion operation of the piston and the piston rod is abnormal.

By calculating the first integral flow rate or the second integral flow rate, it is possible to estimate the operation stroke until the piston reaches the one end or the other end inside the cylinder body. Consequently, the distance that the piston moves can be specified.

In the third or fifth determination methods described above, the operation state monitoring device may further include a notification unit configured to issue a notification of a determination result to exterior, in a case that the determination unit determines that the reciprocal motion of the piston and the piston rod is abnormal. In accordance with this feature, it is possible to notify the user of the occurrence of an abnormal state.

Moreover, in the second to fifth determination methods described above, preferably, the switching valve is a single acting or double acting type of solenoid valve. In double acting type solenoid valves, there are included a solenoid type electromagnetic valve in which solenoids are provided on both sides of the electromagnetic valve, and a solenoid type electromagnetic valve in which a plurality of solenoids are arranged on one side of the electromagnetic valve.

Further, in the first to fifth determination methods described above, the determination process in the determination unit may be performed by way of digital signal processing. More specifically, the operation state monitoring device further includes a reference value setting unit configured to set at least the first reference differential pressure and the second reference differential pressure, a display unit configured to display at least the first reference differential pressure and the second reference differential pressure that were set, and a storage unit configured to store at least the first reference differential pressure and the second reference differential pressure that were set.

In this case, the first pressure detecting unit is configured to output a first pressure signal corresponding to the first pressure value to the determination unit, and the second pressure detecting unit is configured to output a second pressure signal corresponding to the second pressure value to the determination unit. The determination unit is configured to include a microcomputer, and using the first pressure value and the second pressure value in accordance with the input first pressure signal and the input second pressure signal, and the first reference differential pressure and the second reference differential pressure that were set, the determination unit is configured to determine whether or not the piston has reached the one end or the other end inside the cylinder body.

In accordance with this feature, it is possible to more easily set the first reference differential pressure and the second reference differential pressure, in comparison with a case in which the determination unit is configured in the form of an analog circuit.

In addition, the operation state monitoring device may further include an input/output unit configured to input to the determination unit the respective pressures detected by at least the first pressure detecting unit and the second pressure detecting unit, and to output to exterior a determination result of the determination unit.

Furthermore, the cylinder preferably is a single-shaft type cylinder in which the piston rod is integrally connected to the piston on a side of the first cylinder chamber or on a side of the second cylinder chamber, or alternatively, is a double-shaft type cylinder in which piston rods are integrally connected to the piston respectively on the side of the first cylinder chamber and on the side of the second cylinder chamber.

The above and other objects, features, and advantages of the present invention will become more apparent from the following description of preferred exemplary embodiments when taken in conjunction with the accompanying drawings.

DESCRIPTION OF EMBODIMENTS

Preferred embodiments of a cylinder operation state monitoring device according to the present invention will be described in detail below with reference to the accompanying drawings.

1. Configuration of Present Embodiment

Figure 1:
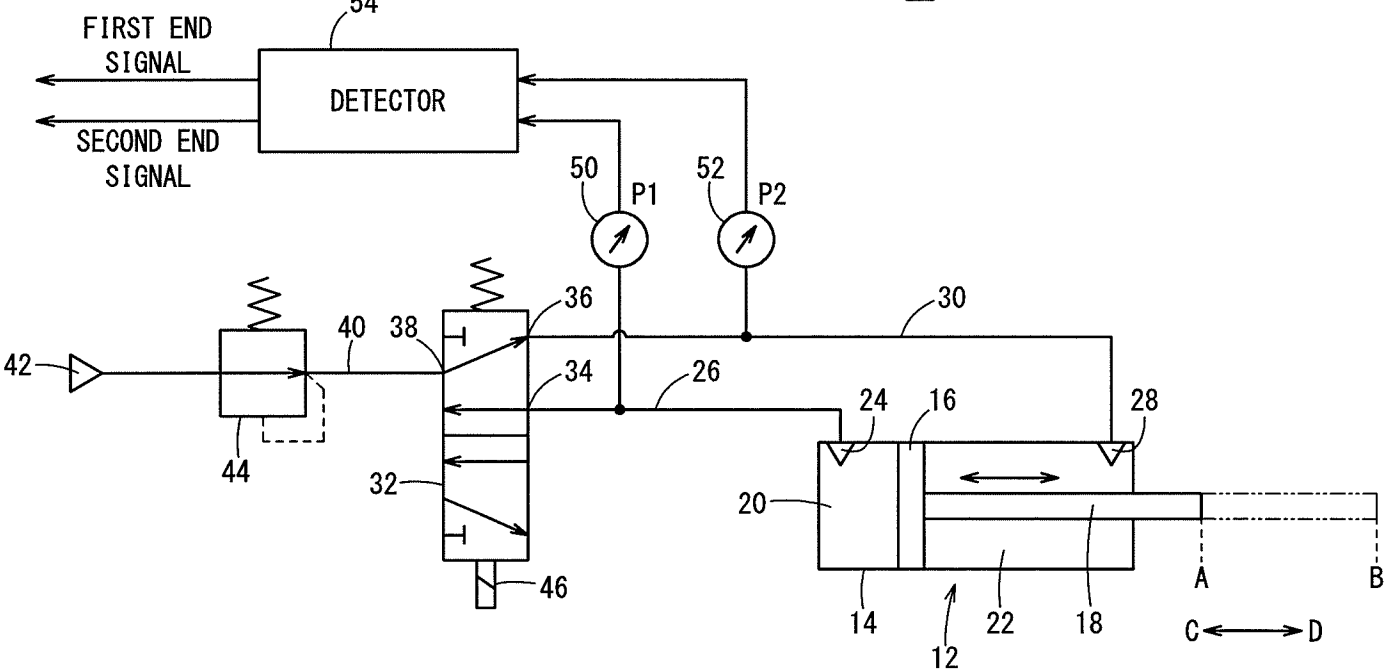
FIG. 1 is a block diagram of a monitoring device according to the present embodiment.

FIG. 1 is a block diagram of a cylinder operation state monitoring device 10 according to the present embodiment (hereinafter, also referred to as a monitoring device 10 according to the present embodiment). The monitoring device 10 functions as a monitoring device for monitoring an operation state of a cylinder 12.

The cylinder 12 includes a cylinder body 14, a piston 16 movably disposed in the interior of the cylinder body 14, and a piston rod 18 connected to the piston 16. In this case, in the interior of the cylinder body 14, a first cylinder chamber 20 is formed between the piston 16 and one end on the left side of FIG. 1, and a second cylinder chamber 22 is formed between the piston 16 and another end on the right side of FIG. 1.

Moreover, in FIG. 1, the piston rod 18 is connected to a side surface of the piston 16 facing toward the second cylinder chamber 22, and the distal end of the piston rod 18 extends outwardly from the right end of the cylinder body 14. Accordingly, the cylinder 12 is a single-shaft type cylinder.

A first port 24 is formed on a side surface of the cylinder body 14 on the side of the first cylinder chamber 20, and one end of a first tube 26 is connected to the first port 24. On the other hand, a second port 28 is formed on a side surface of the cylinder body 14 on the side of the second cylinder chamber 22, and one end of a second tube 30 is connected to the second port 28.

The other end of the first tube 26 is connected to a first connection port 34 of a switching valve 32. Further, the other end of the second tube 30 is connected to a second connection port 36 of the switching valve 32. A supply tube 40 is connected to a supply port 38 of the switching valve 32. The supply tube 40 is connected to a fluid supply source 42, and a pressure reducing valve 44 is provided midway in the supply tube 40.

The switching valve 32 is a single acting type 5-port solenoid valve, which is driven when a command signal (current) is supplied to a solenoid 46 from the exterior. In the present embodiment, the switching valve 32 is not limited to being the solenoid valve shown in FIG. 1, but may be another type of solenoid valve.

For example, two single-acting three-port solenoid valves may be prepared, and one of the solenoid valves may be used as a solenoid valve for the first tube 26 (a solenoid valve for controlling the pressure of the first cylinder chamber 20), together with the other solenoid valve being used as a solenoid valve for the second tube 30 (a solenoid valve for controlling the pressure of the second cylinder chamber 22). Further, instead of a single acting type solenoid valve, a double acting type solenoid valve may be used as the switching valve 32. In double acting type solenoid valves, there are included a solenoid type electromagnetic valve in which solenoids are provided on both sides of the electromagnetic valve, and a solenoid type electromagnetic valve in which a plurality of solenoids are arranged on one side of the electromagnetic valve.

In the following description, a case will be described in which a single acting type 5-port solenoid valve, as shown in FIG. 1, is used as the switching valve 32. However, since the aforementioned other types of solenoid valves are well known, it is easy to replace the single acting type 5-port solenoid valve with another type of solenoid valve.

In this instance, when command signals are not supplied to the solenoid 46, the supply port 38 and the second connection port 36 communicate with each other, together with the first connection port 34 being opened to the exterior. Consequently, the fluid supplied from the fluid supply source 42 is converted into a predetermined pressure by the pressure reducing valve 44, and is supplied via the supply tube 40 to the supply port 38 of the switching valve 32. The fluid (pressure fluid) after pressure conversion thereof is supplied to the second cylinder chamber 22 via the supply port 38, the second connection port 36, the second tube 30, and the second port 28.

As a result, the piston 16 is pressed by the pressure fluid toward the side of the first cylinder chamber 20, and moves in the direction of the arrow C. Together therewith, the fluid (pressure fluid) inside the first cylinder chamber 20, which is pressed by the piston 16, is discharged to the exterior from the first port 24 via the first tube 26, the first connection port 34, and the switching valve 32.

On the other hand, when a command signal is supplied to the solenoid 46, the supply port 38 and the first connection port 34 communicate with each other, together with the second connection port 36 being opened to the exterior. Consequently, the pressure fluid, which is supplied from the fluid supply source 42 and converted into a predetermined pressure by the pressure reducing valve 44, is supplied from the supply tube 40 to the first cylinder chamber 20 via the supply port 38, the first connection port 34, the first tube 26, and the first port 24.

As a result, the piston 16 is pressed by the pressure fluid toward the side of the second cylinder chamber 22, and moves in the direction of the arrow D. Together therewith, the pressure fluid inside the second cylinder chamber 22, which is pressed by the piston 16, is discharged to the exterior from the second port 28 via the second tube 30, the second connection port 36, and the switching valve 32.

In this manner, due to the switching operation of the switching valve 32, the pressure fluid is supplied from the fluid supply source 42 to the first cylinder chamber 20 via the first tube 26, or alternatively, the pressure fluid is supplied to the second cylinder chamber 22 via the second tube 30, whereby the piston 16 and the piston rod 18 can be made to move reciprocally in the direction of the arrow C and the direction of the arrow D. Stated otherwise, the cylinder 12 is a double acting type cylinder.

Moreover, in the present embodiment, a distal end position of the piston rod 18 when the piston 16 is moved to the one end inside the cylinder body 14 along the direction of the arrow C is defined as a position A, and the distal end position of the piston rod 18 when the piston 16 is moved to the other end inside the cylinder body 14 along the direction of the arrow D is defined as a position B. Further, in the description given below, the case in which the piston 16 moves from the one end to the other end inside the cylinder body 14 along the direction of the arrow D during energization of the solenoid 46 (when the switching valve 32 is ON) may also be referred to as "advancement". Further, in the case that the piston 16 reaches the other end inside the cylinder body 14 and the distal end position of the piston rod 18 reaches the position B, the other end, which is the end of the stroke, and the position B may be referred to as a "first end".

On the other hand, in the description given below, the case in which the piston 16 moves from the other end to the one end inside the cylinder body 14 along the direction of the arrow C during non-energization of the solenoid 46 (when the switching valve 32 is OFF) may also be referred to as "retraction". Further, in the case that the piston 16 reaches the one end inside the cylinder body 14 and the distal end position of the piston rod 18 reaches the position A, the one end, which is the end of the stroke, and the position A may be referred to as a "second end".

In the case that the cylinder 12 is configured in the foregoing manner, in addition to the fluid supply source 42, the pressure reducing valve 44, and the switching valve 32, etc., the monitoring device 10 according to the present embodiment further includes a first pressure sensor 50 (first pressure detecting unit), a second pressure sensor (second pressure detecting unit), and a detector 54 (determination unit).

The first pressure sensor 50 sequentially detects a pressure value (first pressure value, pressure) P1 of the pressure fluid inside the first tube 26, and outputs a first pressure signal in accordance with the detected first pressure value P1 to the detector 54. The second pressure sensor 52 sequentially detects a pressure value (second pressure value, pressure) P2 of the pressure fluid inside the second tube 30, and outputs a second pressure signal in accordance with the detected second pressure value P2 to the detector 54.

Moreover, the first pressure sensor 50 and the second pressure sensor 52 can adopt and utilize any of various well-known pressure detecting means. More specifically, there can be adopted as the first pressure sensor 50 and the second pressure sensor 52, (1) a strain gauge type pressure detecting means using a metallic strain gauge, a semiconductor strain gauge, or the like, (2) a capacitance type pressure detecting means using a metallic diaphragm, a silicon diaphragm, or the like, (3) an inductance type pressure detecting means, (4) a force balance type pressure detecting means, or (5) a vibration type pressure detecting means. Descriptions concerning such pressure detecting means are omitted herein.

When the first pressure signal and the second pressure signal are sequentially input, then on the basis of the first pressure value P1 corresponding to the first pressure signal, and the second pressure value P2 corresponding to the second pressure signal, the detector 54 determines whether or not the piston 16 has reached the one end (second end) or the other end (first end) of the cylinder body 14. As a result of such a determination process, the detector 54 outputs a signal (first end signal) indicating that the piston 16 has reached the first end, or a signal (second end signal) indicating that the piston 16 has reached the second end. The specific determination process of the detector 54 will be described later.

Figure 2:
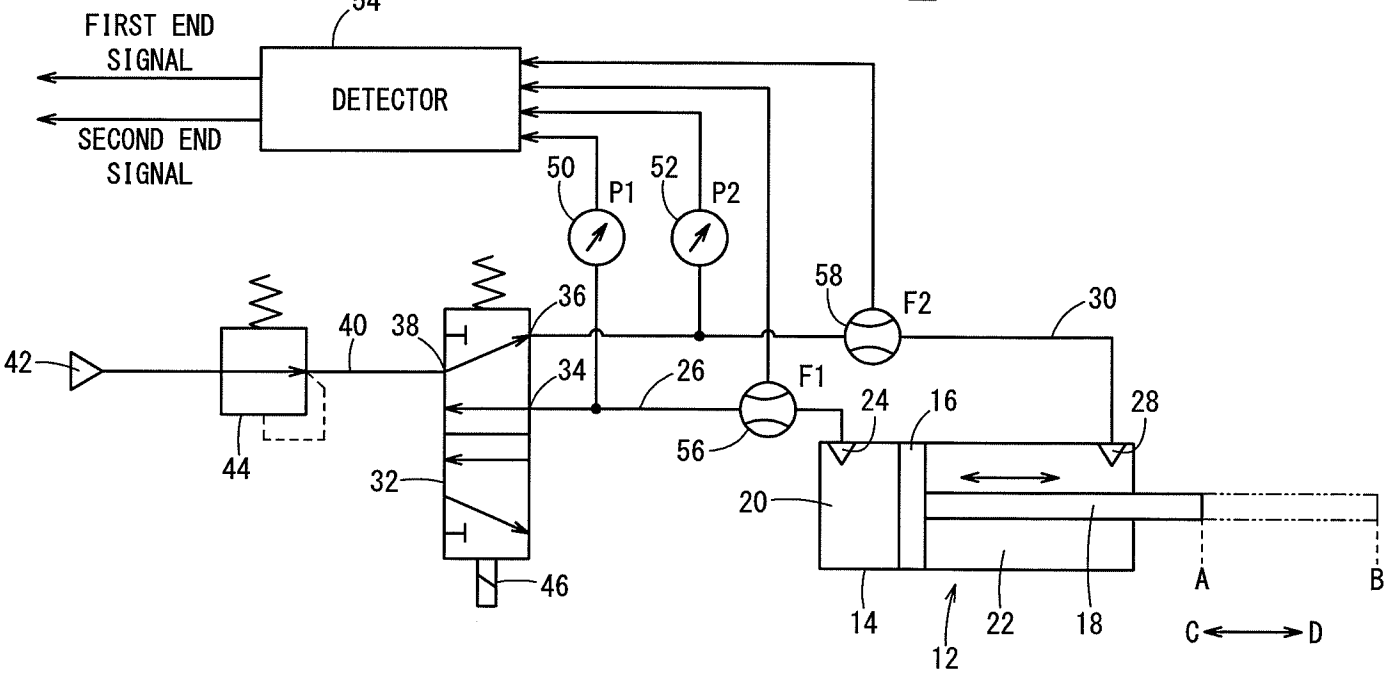
FIG. 2 is a block diagram illustrating another configuration of the monitoring device of FIG. 1.

Further, the monitoring device 10 according to the present embodiment may adopt the configuration shown in FIG. 2 instead of the configuration shown in FIG. 1. In FIG. 2, the monitoring device 10 further includes a first flow rate sensor 56 (first flow rate detecting unit), and a second flow rate sensor 58 (second flow rate detecting unit).

The first flow rate sensor 56 is disposed midway in the first tube 26, and sequentially detects the flow rate (first flow rate) F1 of the pressure fluid inside the first tube 26, and outputs a first flow rate signal in accordance with the detected first flow rate F1 to the detector 54. The second flow rate sensor 58 sequentially detects the flow rate (second flow rate) F2 of the pressure fluid inside the second tube 30, and outputs a second flow rate signal in accordance with the detected second flow rate F2 to the detector 54.

In the case that the first flow rate signal and the second flow rate signal are input in addition to the first pressure signal and the second pressure signal, then on the basis of the first pressure value P1 corresponding to the first pressure signal, the second pressure value P2 corresponding to the second pressure signal, the first flow rate F1 in accordance with the first flow rate signal, and the second flow rate F2 in accordance with the second flow rate signal, the detector 54 performs a determination process as to whether or not the piston 16 has reached the first end or the second end. In this case as well, as a result of the determination process, the detector 54 outputs the first end signal or the second end signal.

Figure 3:
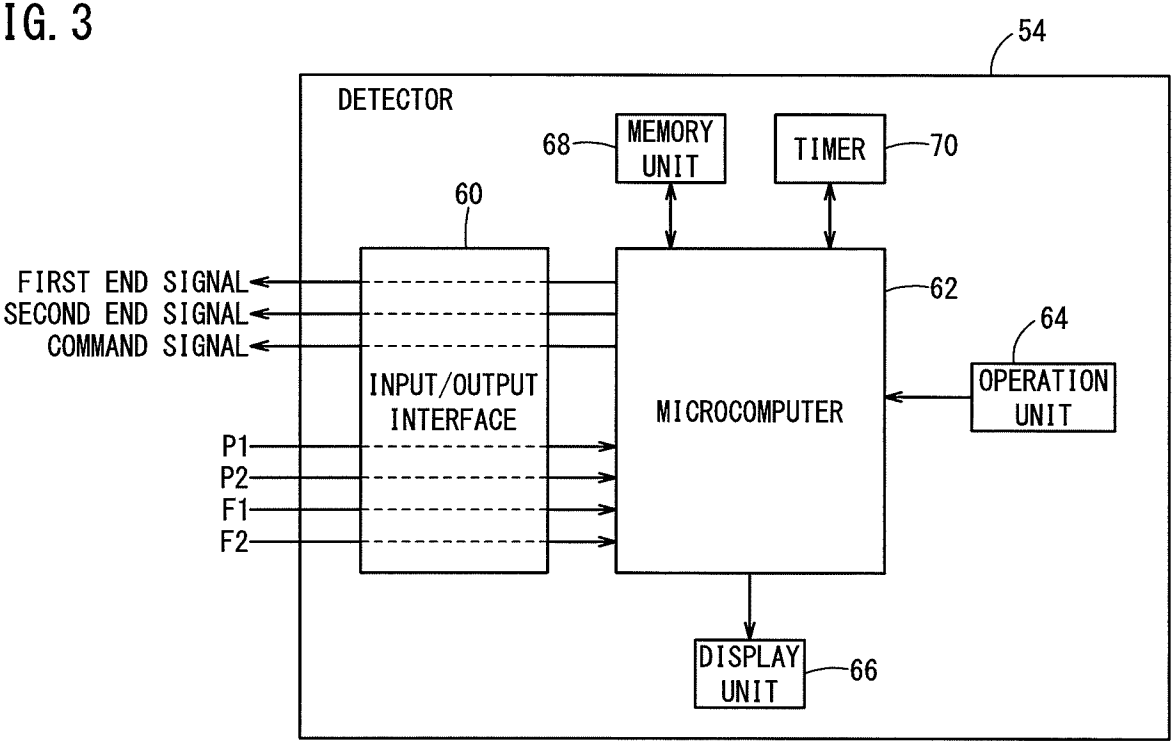
FIG. 3 is a block diagram showing the internal configuration of a detector shown in FIGS. 1 and 2.
Figure 4:
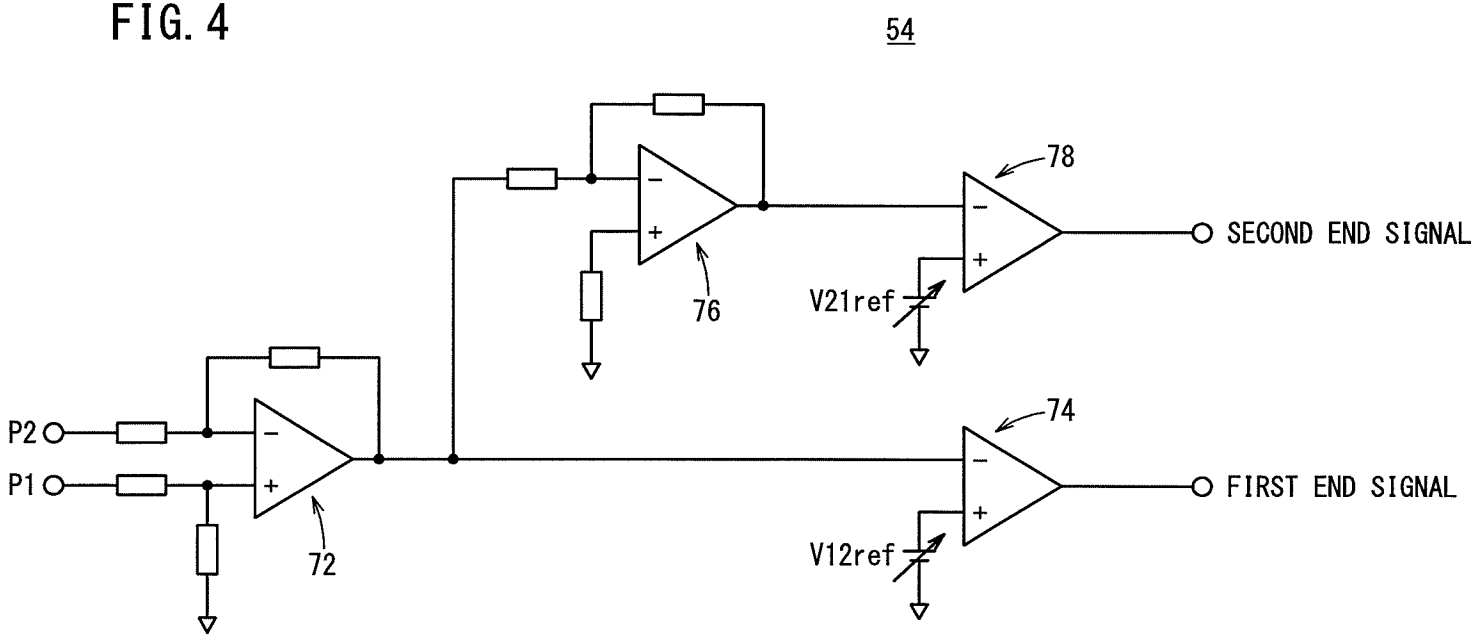
FIG. 4 is a circuit diagram showing another internal configuration of the detector shown in FIGS. 1 and 2.

FIG. 3 is a block diagram showing the internal configuration of the detector 54, and FIG. 4 is a circuit diagram showing another internal configuration of the detector 54. More specifically, the detector 54 of FIG. 3 performs a predetermined digital signal process (determination process) using the first pressure signal and the second pressure signal (as well as the first flow rate signal and the second flow rate signal), thereby generating the first end signal or the second end signal. Further, the detector 54 of FIG. 4 performs a predetermined analog signal process (determination process) using the first pressure signal and the second pressure signal, thereby generating the first end signal or the second end signal.

The digital signal processing type detector 54 of FIG. 3 comprises an input/output interface 60 (input/output unit), a microcomputer 62 (control unit, integral flow rate calculating unit), an operation unit 64 (reference value setting unit), a display unit 66 (notification unit), a memory unit 68 (storage unit), and a timer 70 (time measuring unit).

The monitoring device 10 has a configuration (see FIG. 1) in which the first flow rate sensor 56 and the second flow rate sensor 58 are not included, and a configuration (see FIG. 2) in which the first flow rate sensor 56 and the second flow rate sensor 58 are included. Therefore, in the description of FIG. 3, descriptive content related to the first flow rate signal and the second flow rate signal are indicated in parentheses.

The input/output interface 60 sequentially takes in the first pressure signal and the second pressure signal (as well as the first flow rate signal and the second flow rate signal), and outputs the first pressure value P1 indicated by the first pressure signal and the second pressure value P2 indicated by the second pressure signal (as well as the first flow rate F1 indicated by the first flow rate signal and the second flow rate F2 indicated by the second flow rate signal) to the microcomputer 62. Further, as will be discussed later, in the case that the microcomputer 62 generates the first end signal or the second end signal on the basis of the first pressure value P1 and the second pressure value P2 (as well as the first flow rate F1 and the second flow rate F2), the input/output interface 60 outputs the first end signal or the second end signal to the exterior.

The operation unit 64 is an operating means such as an operation panel, and an operation button or the like which are operated by the user of the monitoring device 10 and the cylinder 12. By operating the operation unit 64, the user sets reference values necessary for the digital signal process (determination process) carried out by the microcomputer 62. The set reference values are supplied to the microcomputer 62. Accordingly, by operating the operation unit 64, the user can appropriately set the aforementioned reference values in accordance with the operating environment of the cylinder 12, the type of the cylinder 12, and the like. As the reference values, the following items may be cited.

(1) A first reference differential pressure ΔP12ref serving as a reference value with respect to the first differential pressure (P1−P2)=ΔP12 between the first pressure value P1 and the second pressure value P2. The first reference differential pressure ΔP12ref is indicative of a minimum value (threshold value) for the first differential pressure ΔP12 when the piston 16 has reached the other end inside the cylinder body 14. Accordingly, if the first differential pressure ΔP12 is greater than the first reference differential pressure ΔP12ref, it can be determined that the piston 16 has reached the other end inside the cylinder body 14.

(2) A second reference differential pressure ΔP21ref serving as a reference value with respect to the second differential pressure (P2−P1)=ΔP21 between the second pressure value P2 and the first pressure value P1. The second reference differential pressure ΔP21ref is indicative of a minimum value (threshold value) for the second differential pressure ΔP21 when the piston 16 has reached the one end inside the cylinder body 14. Accordingly, if the second differential pressure ΔP21 is greater than the second reference differential pressure ΔP21ref, it can be determined that the piston 16 has reached the one end inside the cylinder body 14.

(3) A reference time range Tref indicative of an allowable range of a stroke time T at a time that the piston 16 is operating normally, when the piston 16 moves between the one end and the other end inside the cylinder body 14. If the stroke time T lies within the reference time range Tref, it can be determined that the piston 16 is operating normally, whereas if the stroke time T deviates from the reference time range Tref, it can be determined that the piston 16 is operating abnormally.

(4) A first reference flow rate difference ΔF12ref serving as a reference value with respect to the first flow rate difference (F1−F2)=ΔF12 between the first flow rate F1 and the second flow rate F2. The first reference flow rate difference ΔF12ref is indicative of the maximum value (threshold value) of the first flow rate difference ΔF12 when the piston 16 has reached the other end inside the cylinder body 14. Accordingly, if the first flow rate difference ΔF12 is less than the first reference flow rate difference ΔF12ref, it can be determined that the piston 16 has reached the other end inside the cylinder body 14.

(5) A second reference flow rate difference ΔF21ref serving as a reference value with respect to the second flow rate difference (F2−F1)=ΔF21 between the second flow rate F2 and the first flow rate F1. The second reference flow rate difference ΔF21ref is indicative of a maximum value (threshold value) of the second flow rate difference ΔF21 when the piston 16 has reached the one end inside the cylinder body 14. Accordingly, if the second flow rate difference ΔF21 is less than the second reference flow rate difference ΔF21ref, it can be determined that the piston 16 has reached the one end inside the cylinder body 14.

(6) A reference flow rate range Qref indicative of an allowable range of an integral value (first integral flow rate) Q1 of the first flow rate F1 and an integral value (second integral flow rate) Q2 of the second flow rate F2 at a time that the piston 16 is operating normally. If the first integral flow rate Q1 or the second integral flow rate Q2 lies within the reference flow rate range Qref, it can be determined that the piston 16 is operating normally, whereas if the first integral flow rate Q1 or the second integral flow rate Q2 deviates from the reference flow rate range Qref, it can be determined that the piston 16 is operating abnormally.

Moreover, the setting operation of the above-described respective reference values may be implemented by the user constructing a system including the monitoring device 10 and the cylinder 12, etc., and during a subsequent trial run, by the user operating the operation unit 64 while extracting operating conditions of the cylinder 12. Alternatively, the respective reference values may be set or changed via the input/output interface 60 by communication with the exterior or the like.

The microcomputer 62 calculates the first pressure value P1 and the second pressure value P2 (as well as the first flow rate F1 and the second flow rate F2) that are sequentially input from the input/output interface 60, and calculates the first differential pressure ΔP12 and the second differential pressure ΔP21 (as well as the first flow rate difference ΔF12, the second flow rate difference ΔF21, the first integral flow rate Q1, and the second integral flow rate Q2).

In addition, on the basis of a comparison between the calculated first differential pressure ΔP12 and the second differential pressure ΔP21 (as well as the first flow rate difference ΔF12, the second flow rate difference ΔF21, the first integral flow rate Q1, and the second integral flow rate Q2), and the above-described reference values (the first reference differential pressure ΔP12ref and the second reference differential pressure ΔP21ref (as well as the reference time range Tref, the first reference flow rate difference ΔF12ref, the second reference flow rate difference ΔF21ref, and the reference flow rate range Qref)), the microcomputer 62 determines whether or not the piston 16 has reached the one end (second end) or the other end (first end) inside the cylinder body 14.

In the case that the piston 16 has reached the one end inside the cylinder body 14, the microcomputer 62 generates the second end signal indicating that the piston 16 and the piston rod 18 have reached the second end (position A). On the other hand, in the case that the piston 16 has reached the other end inside the cylinder body 14, the microcomputer 62 generates the first end signal indicating that the piston 16 and the piston rod 18 have reached the first end (position B). The generated first end signal or the second end signal is output to the exterior via the input/output interface 60.

Further, the microcomputer 62 is capable of supplying command signals to the solenoid 46 of the switching valve 32 via the input/output interface 60.

Furthermore, in the case that the timer 70 starts to measure time at a supply start time of the command signal from the microcomputer 62 to the solenoid 46, and from that time, the timer 70 measures the stroke time (elapsed time) T until the piston 16 reaches the first end, then on the basis of a comparison between the stroke time T and the reference time range Tref, the microcomputer 62 is capable of determining whether or not operation of the piston 16 is abnormal. Further, the microcomputer 62 is also capable of determining whether or not operation of the piston 16 is abnormal on the basis of a comparison between the first integral flow rate Q1 or the second integral flow rate Q2 and the reference flow rate range Qref. In the case it is determined that operation of the piston 16 is abnormal, the microcomputer 62 issues a notification to the user via the display unit 66 of a warning indicating that the operation state of the piston 16 is abnormal, or alternatively, issues a notification to the exterior via the input/output interface 60.

The display unit 66 displays the reference values set by the user operating the operation unit 64, or displays the results of various types of determination processes executed in the microcomputer 62. The memory unit 68 stores the respective reference values set by the operation unit 64. As discussed above, the timer 70 measures the stroke time T of the piston 16 inside the cylinder body 14 by initiating measurement of time from the supply start time of the command signal from the microcomputer 62 to the solenoid 46.

On the other hand, the analog signal processing type detector 54 shown in FIG. 4 includes four operational amplifier circuits 72 to 78.

The preceding stage operational amplifier circuit 72 is a differential amplifier (comparison circuit), which detects a signal level difference between the first pressure signal (first pressure value P1) and the second pressure signal (second pressure value P2), and outputs a preceding stage output signal indicative of the signal level difference to the subsequent stage operational amplifier circuits 74, 76. Moreover, the preceding stage output signal is an output signal corresponding to the first differential pressure ΔP12.

The operational amplifier circuit 74 is a comparison circuit, which compares the preceding stage output signal with a reference value (reference voltage) V12ref corresponding to the first reference differential pressure ΔP12ref, and in the case that the voltage value of the preceding stage output signal exceeds the reference voltage V12ref, inverts the output signal of the operational amplifier circuit 74. The output signal, the sign of which is inverted, becomes the first end signal.

On the other hand, the operational amplifier circuit 76 is an inverting amplifier circuit that inverts the preceding stage output signal, and outputs the inverted signal to the operational amplifier circuit 78. Moreover, the output signal (the signal obtained by inverting the preceding stage output signal), which is output from the operational amplifier circuit 76, becomes an output signal in accordance with the second differential pressure ΔP21.

The operational amplifier circuit 78 is a comparison circuit similar to the operational amplifier circuit 74, which compares the output signal from the operational amplifier circuit 76 with a reference value (reference voltage) V21ref corresponding to the second reference differential pressure ΔP21ref, and in the case that the voltage value of the output signal exceeds the reference voltage V21ref, inverts the output signal of the operational amplifier circuit 78. The output signal, the sign of which is inverted, becomes the second end signal.

Moreover, in the same manner as the digital signal processing type detector 54 of FIG. 3, in the analog signal processing type detector 54 of FIG. 4 as well, the user can appropriately adjust the values of the reference voltages V12ref and V21ref in accordance with the operating environment of the cylinder 12, the type of the cylinder 12, and the like.

Figure 5:
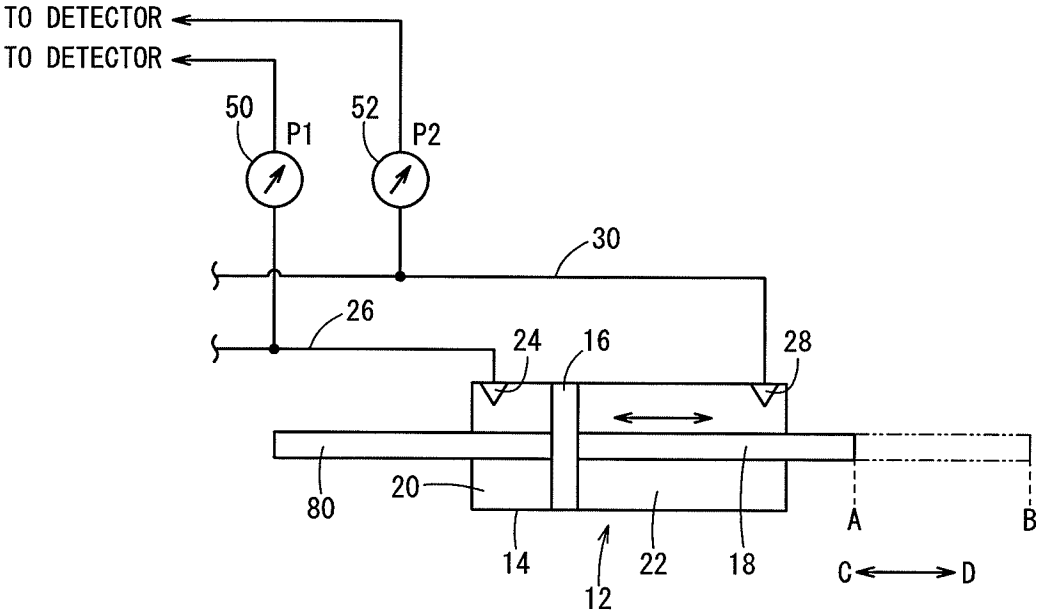
FIG. 5 is an explanatory view in which a double-shaft type cylinder is illustrated.

Further, although a single-shaft type cylinder 12 is shown in FIGS. 1 and 2, as shown in FIG. 5, the monitoring device 10 according to the present embodiment can also be applied to monitoring the operation state of a double-shaft type cylinder 12 in which a piston rod 80 is connected to a side surface of the first cylinder chamber 20 on the piston 16, together with the piston rod 18 being connected to a side surface of the second cylinder chamber 22 on the piston 16. In this case, since the configuration of the monitoring device 10 is the same as in the case of the single-shaft type cylinder 12, detailed description thereof will be omitted.

2. Operations of Present Embodiment

The monitoring device 10 according to the present embodiment is configured in the manner described above. Next, operations of the monitoring device 10 will be described with reference to FIGS. 6 to 18.

In this instance, descriptions will be given concerning the determination processes (first to fifth determination methods) implemented in the detector 54. Further, in the descriptions of the first to fifth determination methods, descriptions will be made concerning a case in which, in the digital signal processing type detector 54, the microcomputer 62 of the detector 54 determines whether or not the piston 16 has reached the one end or the other end inside the cylinder body 14. Furthermore, in the descriptions of the first to fifth determination methods, as necessary, descriptions may also be made with reference to FIGS. 1 to 3.

2.1. First Determination Method

The first determination method is a determination process that serves as a basis of all of the determination methods. That is, in the first determination method, a determination is made as to whether or not the piston 16 has reached the one end (second end) or the other end (first end) inside the cylinder body 14, merely on the basis of a comparison between the first differential pressure ΔP12 (=P1−P2) and the first reference differential pressure ΔP12ref and/or a comparison between the second differential pressure ΔP21 (=P2−P1) and the second reference differential pressure ΔP21ref.

Figure 6:
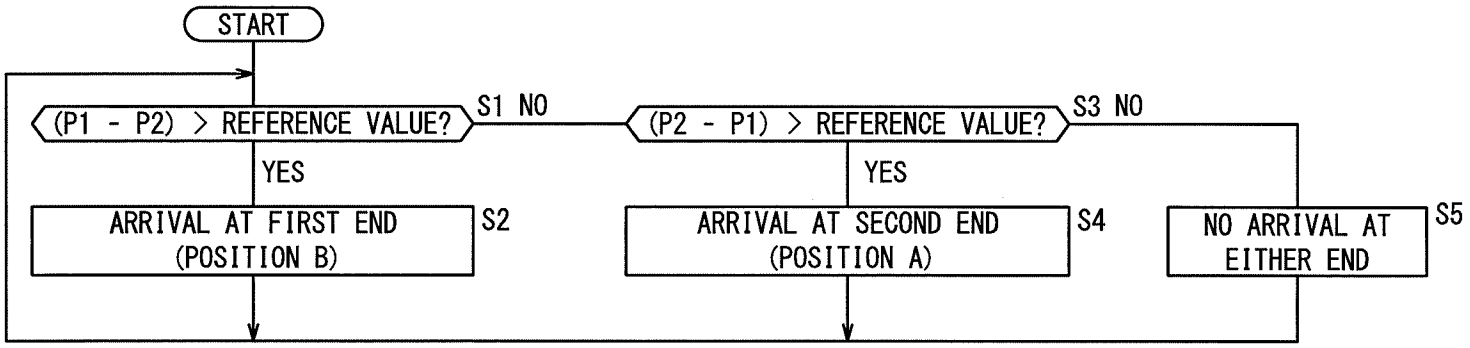
FIG. 6 is a flowchart illustrating a first determination method of the present embodiment.
Figure 7:
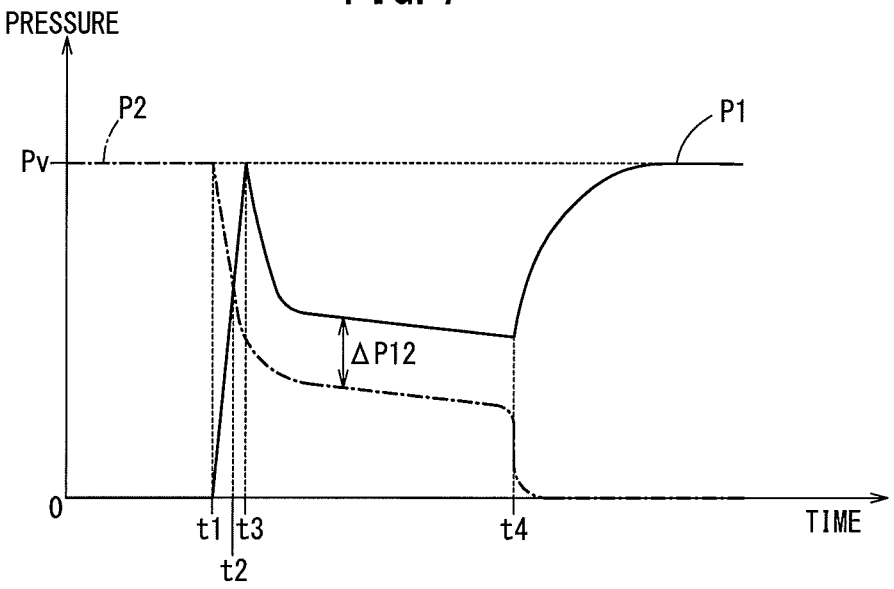
FIG. 7 is a timing chart showing temporal changes of a first pressure value and a second pressure value in the first determination method of FIG. 6.
Figure 8:
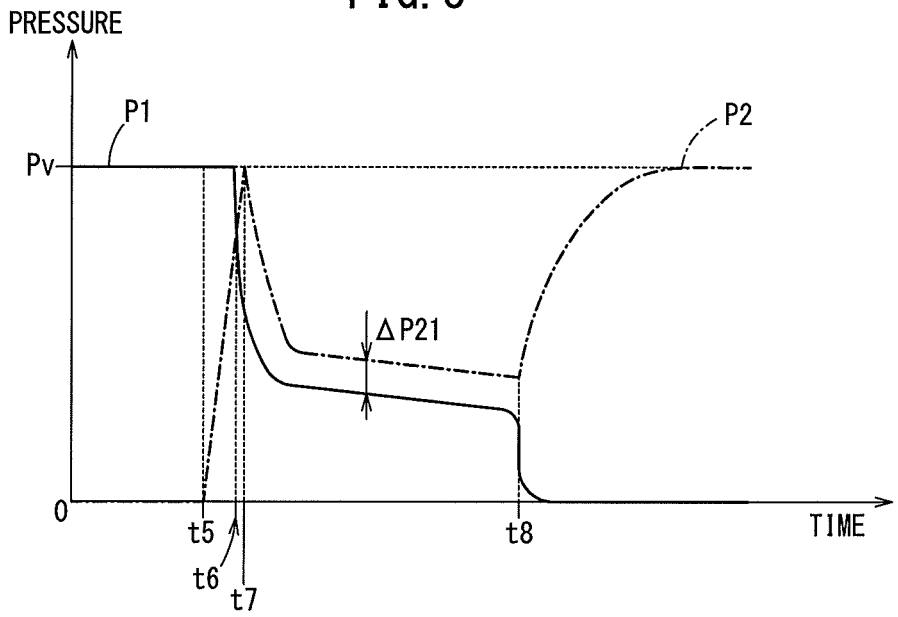
FIG. 8 is a timing chart showing temporal changes of the first pressure value and the second pressure value in the first determination method of FIG. 6.
Figure 9:
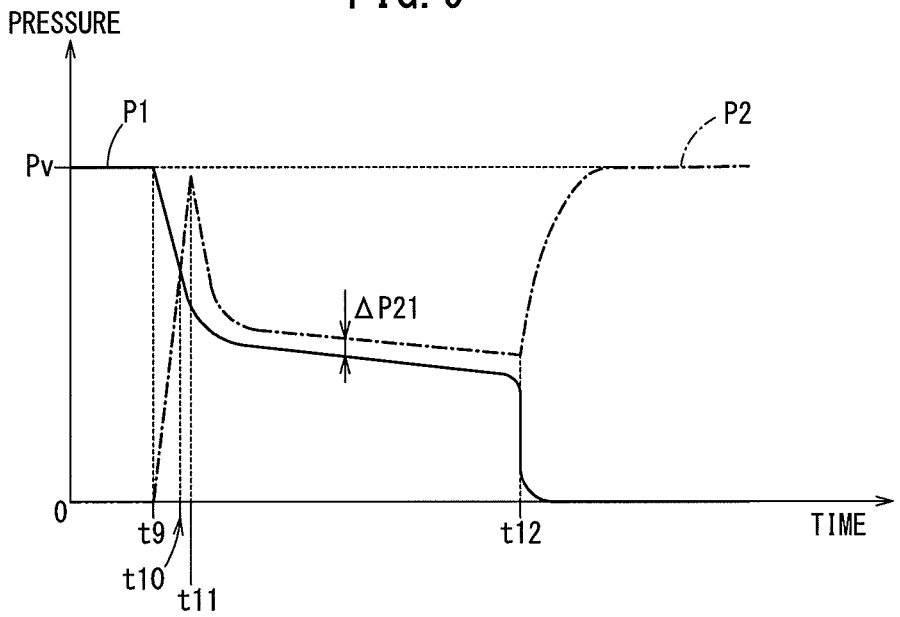
FIG. 9 is a timing chart showing temporal changes of the first pressure value and the second pressure value in the first determination method of FIG. 6.

More specifically, a description will be given with reference to the flowchart of FIG. 6 and the timing charts of FIGS. 7 to 9. FIG. 6 is a flowchart showing a determination process executed by the microcomputer 62. FIG. 7 is a timing chart showing temporal changes of the first pressure value P1 and the second pressure value P2 when the piston 16 and the piston rod 18 are advanced in the direction of the arrow D in the single-shaft type cylinder 12 (see FIG. 1). FIG. 8 is a timing chart showing temporal changes of the first pressure value P1 and the second pressure value P2 when the piston 16 and the piston rod 18 are retracted in the direction of the arrow C in the single-shaft type cylinder 12. FIG. 9 is a timing chart showing temporal changes of the first pressure value P1 and the second pressure value P2 when the piston 16 and the piston rod 18 are retracted in the direction of the arrow C in the double-shaft type cylinder 12 (see FIG. 5).

Herein, the determination process of FIG. 6 will be described after having described each of the timing charts of FIGS. 7 to 9.

In the case of advancing movement of the piston 16 as shown in FIG. 7, at a time that the switching valve 32 of FIG. 1 is OFF (in the time zone before time t1), the pressure fluid is supplied from the fluid supply source 42 to the second cylinder chamber 22 via the pressure reducing valve 44, the supply port 38, the second connection port 36, and the second tube 30. Consequently, the piston 16 is pressed against the one end inside the cylinder body 14. On the other hand, since the first cylinder chamber 20 communicates with atmosphere via the first tube 26 and the first connection port 34, the fluid inside the first cylinder chamber 20 is discharged from the first tube 26 via the switching valve 32. Accordingly, in the time zone before time t1, the first pressure value P1 is approximately zero, and the second pressure value P2 becomes a predetermined pressure value (the pressure value Pv of the pressure fluid output from the pressure reducing valve 44).

Next, at time t1, when a command signal is supplied from the microcomputer 62 of FIG. 3 to the solenoid 46, the switching valve 32 is driven and is turned ON. As a result, the connection state of the switching valve 32 is switched, and supply of pressure fluid from the fluid supply source 42 to the first cylinder chamber 20 via the pressure reducing valve 44, the supply port 38, the first connection port 34, and the first tube 26 is initiated. On the other hand, due to the fact that the second cylinder chamber 22 communicates with atmosphere via the second tube 30 and the second connection port 36, the pressure fluid of the second cylinder chamber 22 begins to be discharged from the second tube 30 to the exterior via the switching valve 32.

Consequently, from time t1, the first pressure value P1 of the pressure fluid inside the first tube 26 increases abruptly with the passage of time, together with the second pressure value P2 of the pressure fluid inside the second tube 30 decreasing abruptly with the passage of time. At time t2, the first pressure value P1 exceeds the second pressure value P2.

Thereafter, at time t3, the first pressure value P1 rises to a predetermined pressure value (for example, the second pressure value P2 (pressure value Pv) before time t1), and the piston 16 starts to be advanced in the direction of the arrow D. In this case, when the piston 16 begins to move in the direction of the arrow D, due to the change in volume of the first cylinder chamber 20, the first pressure value P1 decreases from the pressure value Pv, and together therewith, the second pressure value P2 also decreases.

Moreover, in FIG. 7, although a case is illustrated in which the first pressure value P1 rises to the pressure value Pv at time t3, in reality, there may also be a case in which the piston 16 starts to be advanced in the direction of the arrow D before the first pressure value P1 rises to the pressure value Pv. In the following explanation, a description will be given concerning a case in which the piston 16 starts undergoing advancement or retraction after the first pressure value P1 or the second pressure value P2 has risen to the pressure value Pv or a value in the vicinity thereof.

During advancement of the piston 16, the first pressure value P1 and the second pressure value P2 gradually decrease with the passage of time due to changes in the volume of the first cylinder chamber 20 and the second cylinder chamber 22. In this case, the first pressure value P1 and the second pressure value P2 decrease while maintaining a substantially constant first differential pressure ΔP12 (=P1−P2) therebetween.

At time t4, when the piston 16 reaches the other end (first end) inside the cylinder body 14, the volume of the second cylinder chamber 22 becomes substantially zero. Therefore, after time t4, the second pressure value P2 decreases to substantially zero (atmospheric pressure), together with the first pressure value P1 rising toward the pressure value Pv. More specifically, when the piston 16 reaches the other end inside the cylinder body 14, the first differential pressure ΔP12 increases abruptly from a constant value.

On the other hand, in the case of retracting movement of the piston 16 as shown in FIG. 8, at a time that the switching valve 32 of FIG. 1 is ON (in the time zone before time t5), the pressure fluid is supplied from the fluid supply source 42 to the first cylinder chamber 20 via the pressure reducing valve 44, the supply port 38, the first connection port 34, and the first tube 26, and the piston 16 is pressed to the other side inside the cylinder body 14. On the other hand, since the second cylinder chamber 22 communicates with atmosphere via the second tube 30 and the second connection port 36, the fluid inside the second cylinder chamber 22 is discharged from the second tube 30 via the switching valve 32. Accordingly, in the time zone before time t5, the first pressure value P1 is the pressure value Pv, and the second pressure value P2 is substantially zero.

Next, at time t5, when supply of the command signal from the microcomputer 62 of FIG. 3 to the solenoid 46 is stopped, the switching valve 32 stops being driven and is turned OFF. As a result, due to the resilient force of a spring of the switching valve 32, the connection state of the switching valve 32 is switched, and supply of pressure fluid from the fluid supply source 42 to the second cylinder chamber 22 via the pressure reducing valve 44, the supply port 38, the second connection port 36, and the second tube 30 is initiated. On the other hand, due to the fact that the first cylinder chamber 20 communicates with atmosphere via the first tube 26 and the first connection port 34, the pressure fluid of the first cylinder chamber 20 begins to be discharged from the first tube 26 to the exterior via the switching valve 32.

Consequently, from time t5, the second pressure value P2 of the pressure fluid inside the second tube 30 increases abruptly with the passage of time. Thereafter, the first pressure value P1 of the pressure fluid inside the first tube 26 starts to decrease abruptly with the passage of time. As a result, at time t6, the second pressure value P2 exceeds the first pressure value P1.

Thereafter, at time t7, the second pressure value P2 rises to a predetermined pressure value (for example, the pressure value Pv), and the piston 16 starts to be retracted in the direction of the arrow C. In this case, due to the change in volume of the second cylinder chamber 22, the second pressure value P2 decreases from the pressure value Pv, and together therewith, the first pressure value P1 also decreases.

During retraction of the piston 16, the first pressure value P1 and the second pressure value P2 gradually decrease with the passage of time due to changes in the volume of the first cylinder chamber 20 and the second cylinder chamber 22. In this case, the first pressure value P1 and the second pressure value P2 decrease while maintaining a substantially constant second differential pressure ΔP21 (=P2−P1) therebetween.

Moreover, the absolute value of the first differential pressure ΔP12 shown in FIG. 7, and the absolute value of the second differential pressure ΔP21 shown in FIG. 8 differ in size from each other. Such a feature is due to the fact that, on the piston 16 shown in FIG. 1, the piston rod 18 is connected to the side surface (right side surface) of the second cylinder chamber 22, whereby the piston areas differ between the right side surface and the side surface (left side surface) of the first cylinder chamber 20 on the piston 16.

At time t8, when the piston 16 reaches the one end inside the cylinder body 14, the volume of the first cylinder chamber 20 becomes substantially zero. Therefore, after time t8, the first pressure value P1 decreases to substantially zero (atmospheric pressure), together with the second pressure value P2 rising toward the pressure value Pv. More specifically, when the piston 16 reaches the one end inside the cylinder body 14, the second differential pressure ΔP21 increases abruptly from a constant value.

Even during retracting movement of the piston 16 in the double-shaft type cylinder 12 (refer to FIG. 5) of FIG. 9, similar to the retraction operation shown in FIG. 8, during the time at which the switching valve 32 of FIG. 1 is turned ON (in the time zone before time t9), the pressure fluid is supplied to the first cylinder chamber 20, and the piston 16 is pressed toward the other end inside the cylinder body 14. On the other hand, the fluid of the second cylinder chamber 22 is discharged from the second tube 30 via the switching valve 32. Accordingly, in the time zone before time t9, the first pressure value P1 is the pressure value Pv, and the second pressure value P2 is substantially zero.

Next, at time t9, when supply of the command signal from the microcomputer 62 of FIG. 3 to the solenoid 46 is stopped, the switching valve 32 stops being driven and is turned OFF. As a result, the connection state of the switching valve 32 is switched, and the supply of pressure fluid from the fluid supply source 42 to the second cylinder chamber 22 is started. On the other hand, the pressure fluid of the first cylinder chamber 20 starts to be discharged to the exterior from the first tube 26 via the switching valve 32.

Consequently, from time t9, the second pressure value P2 of the pressure fluid inside the second tube 30 increases abruptly with the passage of time, together with the first pressure value P1 of the pressure fluid inside the first tube 26 decreasing abruptly with the passage of time. As a result, at time t10, the second pressure value P2 exceeds the first pressure value P1.

Thereafter, at time t11, the second pressure value P2 rises to a predetermined pressure value (for example, a pressure value in the vicinity of the pressure value Pv), and the piston 16 starts to be retracted in the direction of the arrow C. In this case, due to the change in volume of the second cylinder chamber 22, the second pressure value P2 decreases from the pressure value Pv, and together therewith, the first pressure value P1 also decreases.

During retraction of the piston 16, due to changes in the volume of the first cylinder chamber 20 and the second cylinder chamber 22, the first pressure value P1 and the second pressure value P2 gradually decrease with the passage of time while maintaining the second differential pressure ΔP21 (=P2−P1) substantially constant.

At time t12, when the piston 16 reaches the one end inside the cylinder body 14, the volume of the first cylinder chamber 20 becomes substantially zero. As a result, after time t12, the first pressure value P1 decreases to substantially zero (atmospheric pressure), whereas the second pressure value P2 rises toward the pressure value Pv. Consequently, the second differential pressure ΔP21 increases abruptly from a constant value.

Moreover, in the double-shaft type cylinder 12, piston rods 18, 80 are respectively connected to both side surfaces of the piston 16, and the piston areas on both side surfaces are substantially the same. Therefore, in relation to the time of advancing movement of the piston 16, by replacing a temporal change characteristic of the first pressure value P1 of FIG. 9 with a characteristic of the second pressure value P2, replacing a temporal change characteristic of the second pressure value P2 with the first pressure value P1, and replacing the second differential pressure ΔP21 with the first differential pressure ΔP12, it is possible to obtain a temporal change characteristic at the time of advancing movement.

Thus, in the first determination method, by grasping an abrupt change of the first differential pressure ΔP12 or the second differential pressure ΔP21 at the aforementioned times t4, t8, t12, it is determined whether or not the piston 16 has reached the one end (second end) or the other end (first end) inside the cylinder body 14.

More specifically, the first pressure value P1 detected by the first pressure sensor 50, and the second pressure value P2 detected by the second pressure sensor 52 of FIGS. 1 and 5 are sequentially input to the microcomputer 62 via the input/output interface 60 of FIG. 3. Thus, each time the first pressure value P1 and the second pressure value P2 are input, the microcomputer 62 executes the determination process in accordance with the first determination method shown in FIG. 6.

More specifically, in step S1 of FIG. 6, the microcomputer 62 calculates the first differential pressure ΔP12 by subtracting the second pressure value P2 from the first pressure value P1. Next, the microcomputer 62 determines whether or not the first differential pressure ΔP12 exceeds the first reference differential pressure ΔP12ref as a reference value that is stored in advance in the memory unit 68.

In the case that ΔP12>ΔP12ref (step S1: YES), then in the following step S2, since the signs of ΔP12 and ΔP12ref are positive, the microcomputer 62 advances the piston 16 from the one end to the other end inside the cylinder body 14, and determines that the piston 16 has reached the other end (the piston rod 18 has reached the position B). In addition, the microcomputer 62 generates the first end signal indicating that the piston 16 has reached the other end, and outputs the first end signal to the exterior via the input/output interface 60. Further, the microcomputer 62 displays the determination result on the display unit 66, and notifies the user of the arrival of the piston 16 at the first end.

On the other hand, In the case that ΔP12≤ΔP12ref (step S1: NO), then in step S3, the microcomputer 62 calculates the second differential pressure ΔP21 by subtracting the first pressure value P1 from the second pressure value P2. Moreover, the microcomputer 62 may invert the sign of the first differential pressure ΔP12 to thereby calculate the second differential pressure ΔP21 (=−ΔP12). Next, the microcomputer 62 determines whether or not the second differential pressure ΔP21 exceeds the second reference differential pressure ΔP21ref as a reference value that is stored in advance in the memory unit 68.

In the case that ΔP21>ΔP21ref (step S3: YES), then in the following step S4, since the signs of ΔP21 and ΔP21ref are positive, the microcomputer 62 retracts the piston 16 from the other end to the one end inside the cylinder body 14, and determines that the piston 16 has reached the one end (the piston rod 18 has reached the position A). In addition, the microcomputer 62 generates the second end signal indicating that the piston 16 has reached the one end, and outputs the second end signal to the exterior via the input/output interface 60. Further, the microcomputer 62 displays the determination result on the display unit 66, and notifies the user of the arrival of the piston 16 at the second end.

On the other hand, In the case that ΔP21≤ΔP21ref (step S3: NO), then in the following step S5, the microcomputer 62 determines that the piston 16 has not reached the one end or the other end inside the cylinder body 14 (the piston 16 is between the one end and the other end).

Accordingly, in the first determination method, each time the first pressure value P1 and the second pressure value P2 are input, the microcomputer 62 repeatedly executes the determination process of FIG. 6, and determines whether or not the piston 16 has reached the one end or the other end inside the cylinder body 14.

2.2. Second Determination Method

The second determination method is a process in which, in the first determination method of FIGS. 6 to 9, the ON or OFF condition of the switching valve 32 (the presence or absence of supply of the command signal from the microcomputer 62 to the solenoid 46) is taken into consideration, to thereby determine whether or not the piston 16 has reached the one end or the other end inside the cylinder body 14. Accordingly, in the description of the second determination method, the same processing as that of the first determination method will be described in a simplified manner, or descriptions thereof will be omitted. This will also be applied to other determination methods described hereinafter.

Figure 10:
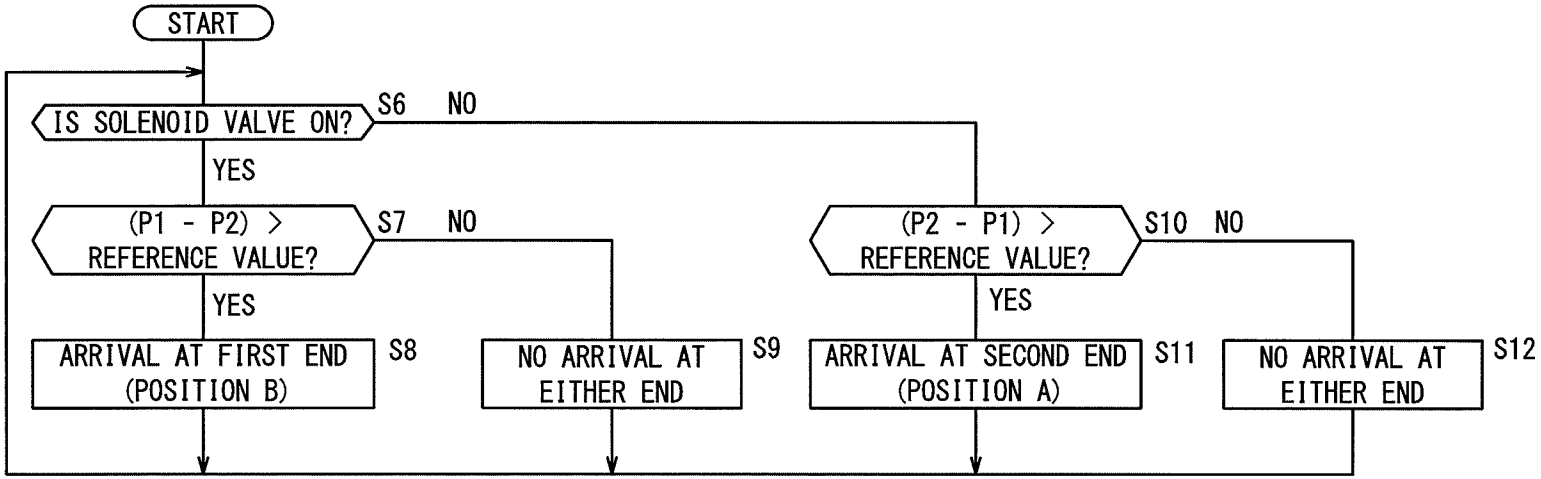
FIG. 10 is a flowchart illustrating a second determination method of the present embodiment.

In the second determination method as well, the first pressure value P1 and the second pressure value P2 are sequentially input to the microcomputer 62 via the input/output interface 60 of FIG. 3, and each time the first pressure value P1 and the second pressure value P2 are input, the microcomputer 62 repeatedly executes the determination process in accordance with the second determination method shown in FIG. 10.

More specifically, in step S6 of FIG. 10, the microcomputer 62 shown in FIG. 3 determines whether or not the switching valve 32 in the form of a solenoid valve is ON (whether or not a command signal is being supplied to the solenoid 46).

In the case that the switching valve 32 is ON (step S6: YES), since the supply port 38 and the first connection port 34 are connected and the pressure fluid is supplied to the first cylinder chamber 20 from the fluid supply source 42, the microcomputer 62 determines that the piston 16 is undergoing advancing movement from the one end toward the other end inside the cylinder body 14.

In addition, in the following step S7, the microcomputer 62 calculates the first differential pressure ΔP12 in the same manner as in step S1 of FIG. 6, and determines whether or not the calculated first differential pressure ΔP12 exceeds the first reference differential pressure ΔP12ref.

In the case that ΔP12>ΔP12ref (step S7: YES), then in the following step S8, the microcomputer 62 determines that the piston 16 has reached the other end inside the cylinder body 14 (the piston rod 18 has reached the position B). In this case, the microcomputer 62 outputs the first end signal to the exterior via the input/output interface 60, together with displaying the above-described determination result on the display unit 66, and notifying the user of the arrival of the piston 16 at the first end.

On the other hand, in the case that ΔP12≤ΔP12ref (step S7: NO), then in step S9, the microcomputer 62 determines that the piston 16, although advancing along the direction of the arrow D, has not reached the other end inside the cylinder body 14.

In the above-described step S6, in the case that the switching valve 32 is OFF (step S6: NO), since the supply port 38 and the second connection port 36 are connected and the pressure fluid is supplied to the second cylinder chamber 22 from the fluid supply source 42, the microcomputer 62 determines that the piston 16 is undergoing retracting movement from the other end toward the one end inside the cylinder body 14.

In addition, in the following step S10, the microcomputer 62 calculates the second differential pressure ΔP21 in the same manner as in step S3 of FIG. 6, and determines whether or not the calculated second differential pressure ΔP21 exceeds the second reference differential pressure ΔP21ref.

In the case that ΔP21>ΔP21ref (step S10: YES), then in the following step S11, the microcomputer 62 determines that the piston 16 has reached the one end inside the cylinder body 14 (the piston rod 18 has reached the position A). In this case, the microcomputer 62 outputs the second end signal to the exterior via the input/output interface 60, together with displaying the above-described determination result on the display unit 66, and notifying the user of the arrival of the piston 16 at the second end.

On the other hand, in the case that ΔP21≤ΔP21ref (step S10: NO), then in step S12, the microcomputer 62 determines that the piston 16, although being retracted along the direction of the arrow C, has not reached the one end inside the cylinder body 14.

Accordingly, in the second determination method, in addition to the features of the first determination method, by recognizing the ON or OFF state of the switching valve 32 and specifying the movement direction of the piston 16, it is possible to improve the reliability of the determination process in relation to the arrival of the piston 16 at the one end or the other end inside the cylinder body 14.

2.3. Third Determination Method

The third determination method is a process in which, in the second determination method of FIG. 10, the stroke time of the piston 16 is taken into consideration, to thereby determine whether or not the piston 16 has reached the one end or the other end inside the cylinder body 14.

In this instance, with reference to FIGS. 12 and 13, first describing the stroke time of the piston 16, thereafter, with reference to the flowchart of FIG. 11, a description will be given concerning the determination process in accordance with the third determination method performed by the microcomputer 62.

Figure 12:
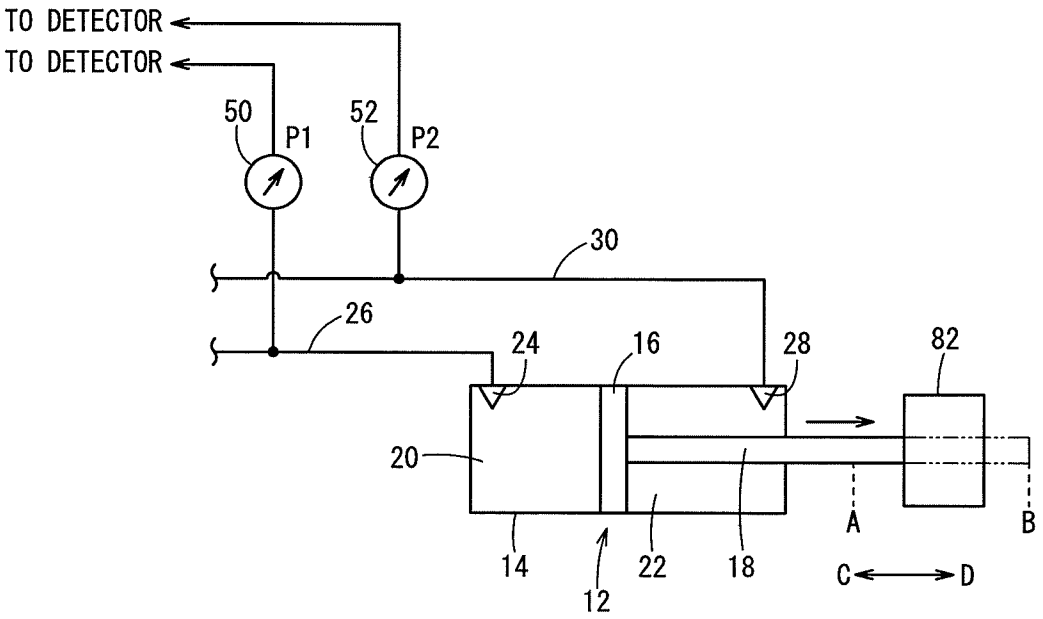
FIG. 12 is an explanatory view showing a case in which a distal end of a piston rod collides with an obstacle.

FIG. 12 is an explanatory view showing a case in which a distal end of the piston rod 18 collides with an obstacle 82, for a case in which the piston 16 and the piston rod 18 are advanced in the direction of the arrow D. In an abnormal state as shown in FIG. 12, even if the piston 16 is located between the one end and the other end inside the cylinder body 14, there is a possibility that the first differential pressure ΔP12 or the second differential pressure ΔP21 may exceed the first reference differential pressure ΔP12ref or the second reference differential pressure ΔP21ref, and that the arrival of the piston 16 at the one end or the other end may be erroneously detected.

Further, in the case that the setting of the first reference differential pressure ΔP12ref or the second reference differential pressure ΔP21ref is changed by operation of the operation unit 64 by the user, or in the case that the pressure fluid leaks from the cylinder 12, the first tube 26, the second tube 30, or the like, then even if the piston 16 is located between the one end and the other end inside the cylinder body 14, there is a possibility that the first differential pressure ΔP12 or the second differential pressure ΔP21 may exceed the first reference differential pressure ΔP12ref or the second reference differential pressure ΔP21ref, and that the arrival of the piston 16 at the one end or the other end may be erroneously detected.

Figure 13:
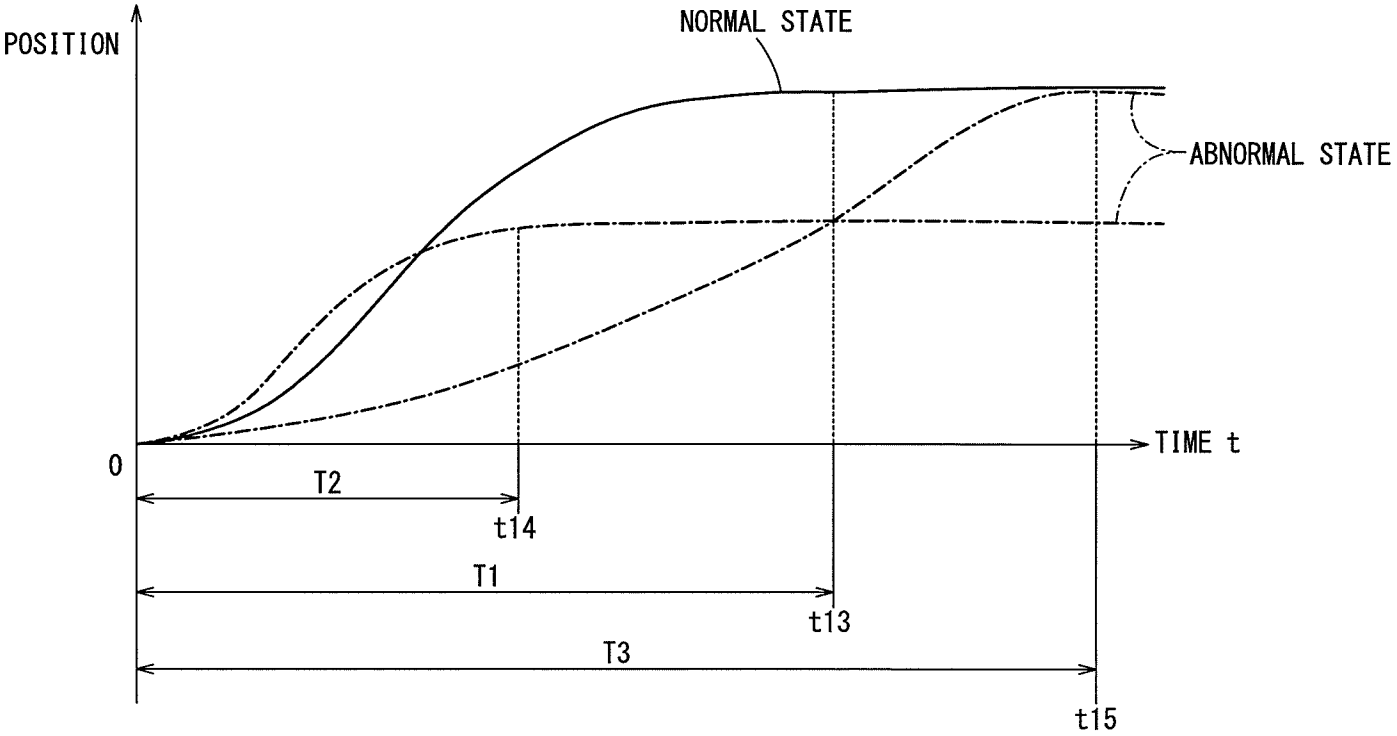
FIG. 13 is a timing chart illustrating temporal changes of the piston.

Additionally, as shown in FIG. 13, in each of the aforementioned abnormal conditions, the stroke time (arrival time period) T of the piston 16 at the one end or the other end inside the cylinder body 14 may be shorter or longer in comparison with the arrival time period T1 thereof in a normal state.

More specifically, in a normal state, after the switching valve 32 has been turned ON at time t=0, the piston 16 reaches the other end inside the cylinder body 14 at time point t13 when the arrival time period T1 has elapsed. In contrast thereto, in an abnormal state, the piston 16 may reach the other end inside the cylinder body 14 earlier, i.e., at time t14 when the arrival time period T2 from t=0 has elapsed, or alternatively, there is a possibility that the piston 16 may reach the other end inside the cylinder body 14 later, i.e., at time t15 when the arrival time period T3 from t=0 has elapsed.

In these states, as in the first and second determination methods described above, such abnormal conditions are difficult to detect merely by comparing the first differential pressure ΔP12 or the second differential pressure ΔP21 with the first reference differential pressure ΔP12ref or the second reference differential pressure ΔP21ref.

Thus, in the third determination method, a determination is made as to whether or not the movement operation of the piston 16 is abnormal, by determining whether or not the stroke time T (the stroke time between one end and the other end) of the piston 16 inside the cylinder body 14 lies within a predetermined reference time range Tref. Moreover, in the third determination method as well, the first pressure value P1 and the second pressure value P2 are sequentially input to the microcomputer 62 via the input/output interface 60 of FIG. 3. Accordingly, each time the first pressure value P1 and the second pressure value P2 are input, the microcomputer 62 repeatedly executes the determination process in accordance with the third determination method shown in FIG. 11.

Figure 11:
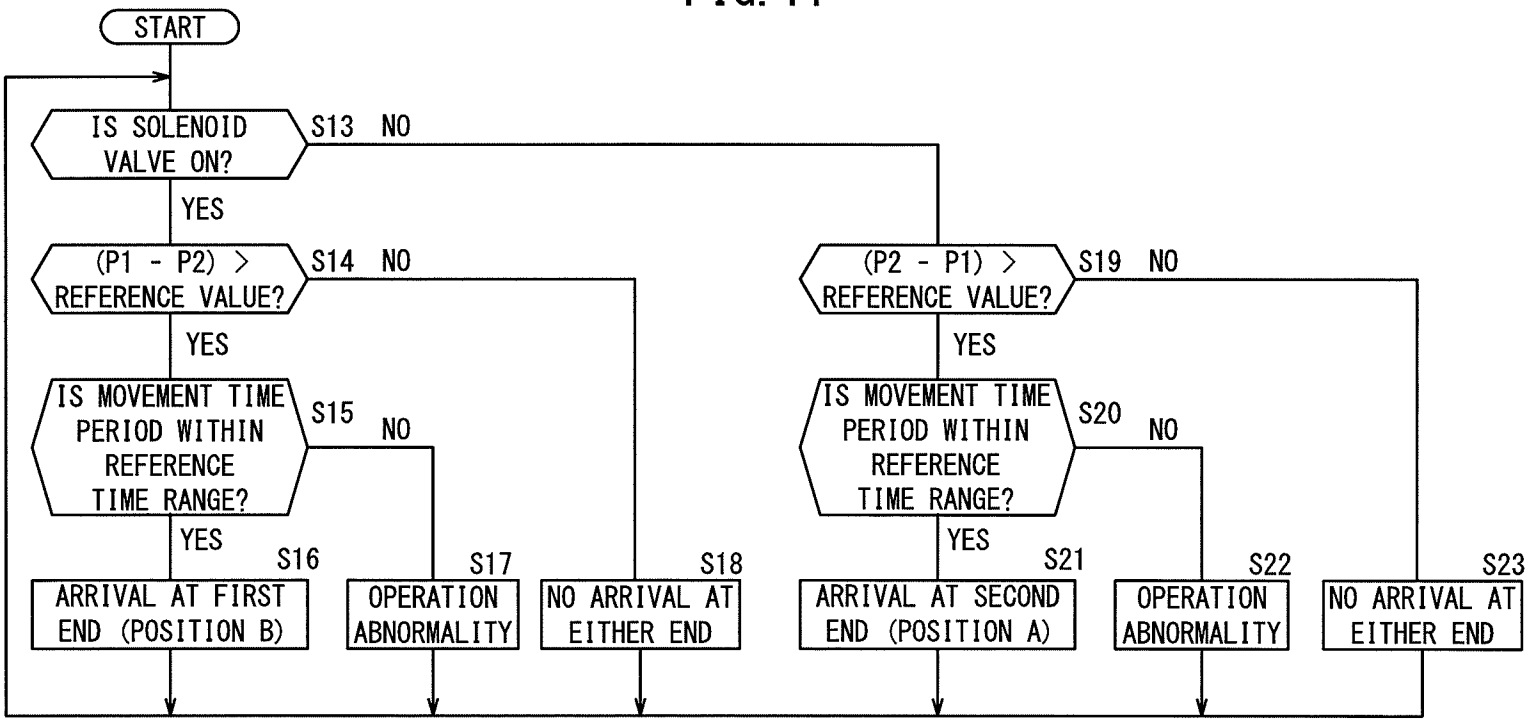
FIG. 11 is a flowchart illustrating a third determination method of the present embodiment.

More specifically, in step S13 of FIG. 11, the microcomputer 62 of FIG. 3 determines whether or not the switching valve 32 is ON, in the same manner as in step S6 of FIG. 10.

In the case that the switching valve 32 is ON (step S13: YES), by the pressure fluid being supplied to the first cylinder chamber 20 from the fluid supply source 42, the microcomputer 62 determines that the piston 16 is undergoing advancing movement from the one end toward the other end inside the cylinder body 14.

In addition, in the following step S14, the microcomputer 62 calculates the first differential pressure ΔP12 in the same manner as in step S1 of FIG. 6 and step S7 of FIG. 10, and determines whether or not the calculated first differential pressure ΔP12 exceeds the first reference differential pressure ΔP12ref.

In the case that ΔP12>ΔP12ref (step S14: YES), the microcomputer 62 determines that there is a possibility that the piston 16 will reach the other end inside the cylinder body 14 (that the piston rod 18 will reach the position B). In addition, in the following step S15, the microcomputer 62 determines whether or not the stoke time T of the piston 16 from the one end to the other end inside the cylinder body 14 lies within the reference time range Tref that was previously stored in the memory unit 68.

In the case that the stroke time T lies within the reference time range Tref (step S15: YES), then in the following step S16, the microcomputer 62 determines that the piston 16 has reached the other end inside the cylinder body 14 (the piston rod 18 has reached the position B) due to the normal advancing movement thereof. In addition, the microcomputer 62 outputs the first end signal to the exterior via the input/output interface 60, together with displaying the above-described determination result on the display unit 66, and notifying the user that the piston 16 has arrived normally at the first end.

On the other hand, in the case that the stroke time T deviates from the reference time range Tref (step S15: NO), then in step S17, the microcomputer 62 determines that operation of the piston 16 is abnormal, and warns the user by displaying the determination result on the display unit 66.

Further, in step S14, in the case that $\Delta P12 \leq \Delta P12ref$ (step S14: NO), then in step S18, the microcomputer 62 determines that the piston 16, although advancing along the direction of the arrow D, has not reached the other end inside the cylinder body 14.

In the above-described step S13, in the case that the switching valve 32 is OFF (step S13: NO), then by the pressure fluid being supplied to the second cylinder chamber 22 from the fluid supply source 42, the microcomputer 62 determines that the piston 16 is undergoing retracting movement from the other end toward the one end inside the cylinder body 14.

In addition, in the following step S19, the microcomputer 62 calculates the second differential pressure $\Delta P21$ in the same manner as in step S3 of FIG. 6 and step S10 of FIG. 10, and determines whether or not the calculated second differential pressure $\Delta P21$ exceeds the second reference differential pressure $\Delta P21ref$.

In the case that $\Delta P21 > \Delta P21ref$ (step S19: YES), the microcomputer 62 determines that there is a possibility that the piston 16 will reach the one end inside the cylinder body 14 (that the piston rod 18 will reach the position A). In addition, in the following step S20, the microcomputer 62 determines whether or not the stroke time T of the piston 16 from the other end to the one end inside the cylinder body 14 lies within the reference time range Tref.

In the case that the stroke time T lies within the reference time range Tref (step S20: YES), then in the following step S21, the microcomputer 62 determines that the piston 16 has reached the one end inside the cylinder body 14 (the piston rod 18 has reached the position A) due to the normal retracting movement thereof. In addition, the microcomputer 62 outputs the second end signal to the exterior via the input/output interface 60, together with displaying the above-described determination result on the display unit 66, and notifying the user that the piston 16 has arrived normally at the second end.

On the other hand, in the case that the stroke time T deviates from the reference time range Tref (step S20: NO), then in step S22, the microcomputer 62 determines that operation of the piston 16 is abnormal, and warns the user by displaying the determination result on the display unit 66.

Further, in step S19, in the case that $\Delta P21 \leq \Delta P21ref$ (step S19: NO), then in step S23, the microcomputer 62 determines that the piston 16, although being retracted along the direction of the arrow C, has not reached the one end inside the cylinder body 14.

In the foregoing manner, in the third determination method, in addition to the features of the second determination method, the stroke time T of the piston 16 is also determined, and therefore, it is possible to detect the presence or absence of an abnormality in the movement operation of the piston 16.

2.4. Fourth Determination Method

The fourth determination method is a process in which, in the second determination method of FIG. 10, the first flow rate F1 and the second flow rate F2 are taken into consideration, to thereby determine whether or not the piston 16 has reached the one end or the other end inside the cylinder body 14.

In this instance, with reference to FIGS. 15 to 17, first describing the temporal change characteristics of the first flow rate F1 and the second flow rate F2, thereafter, with reference to the flowchart of FIG. 14, a description will be given concerning the determination process in accordance with the fourth determination method performed by the microcomputer 62.

Figure 15:
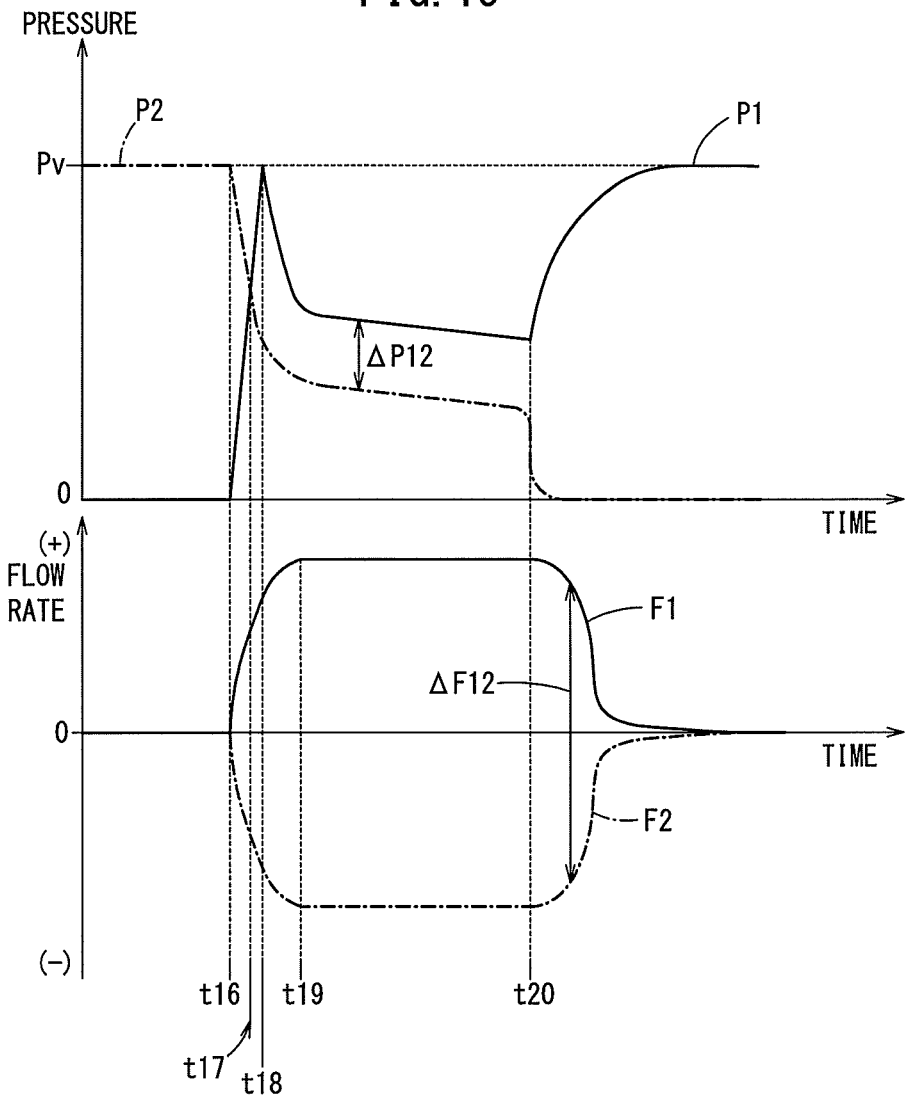
FIG. 15 is a timing chart showing temporal changes of a first pressure value, a second pressure value, a first flow rate, and a second flow rate in the fourth determination method of FIG. 14.

FIG. 15 is a timing chart showing temporal changes of the first pressure P1, the second pressure P2, the first flow rate F1, and the second flow rate F2 when the piston 16 and the piston rod 18 are advanced in the direction of the arrow D in the single-shaft type cylinder 12 (see FIG. 2). Accordingly, the temporal change characteristics of the first pressure value P1 and the second pressure value P2 shown in FIG. 15 are the same as the temporal change characteristics of the first pressure value P1 and the second pressure value P2 shown in FIG. 7.

Figure 16:
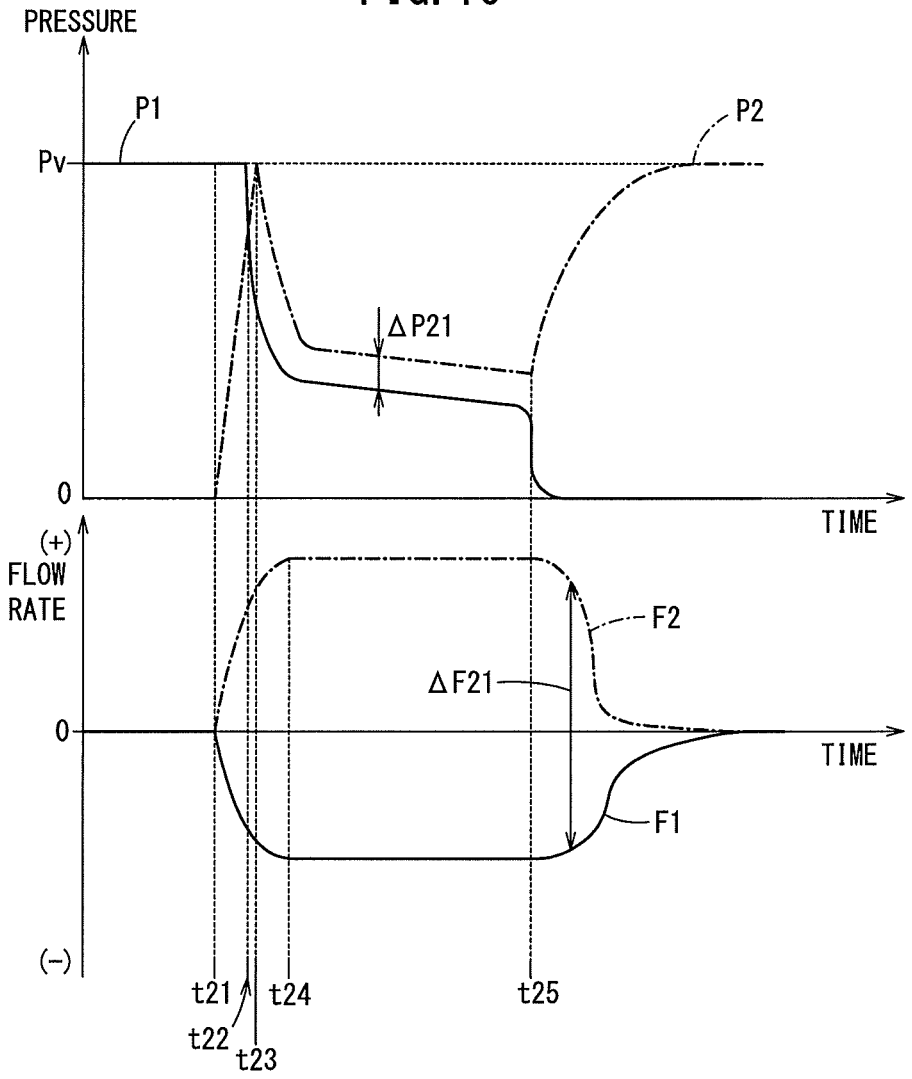
FIG. 16 is a timing chart showing temporal changes of the first pressure value, the second pressure value, the first flow rate, and the second flow rate in the fourth determination method of FIG. 14.

FIG. 16 is a timing chart showing temporal changes of the first pressure P1, the second pressure P2, the first flow rate F1, and the second flow rate F2 when the piston 16 and the piston rod 18 are retracted in the direction of the arrow C in the single-shaft type cylinder 12. Accordingly, the temporal change characteristics of the first pressure value P1 and the second pressure value P2 shown in FIG. 16 are the same as the temporal change characteristics of the first pressure value P1 and the second pressure value P2 shown in FIG. 8.

Figure 17:
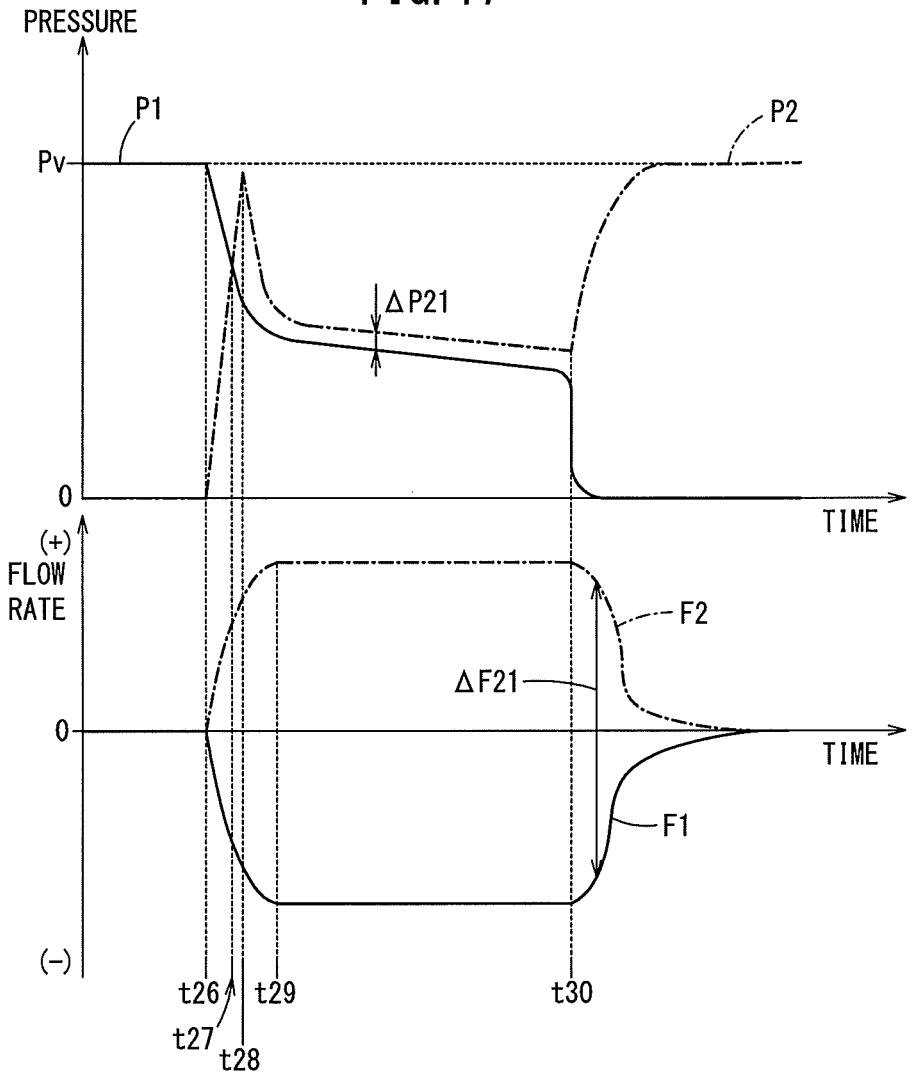
FIG. 17 is a timing chart showing temporal changes of the first pressure value, the second pressure value, the first flow rate, and the second flow rate in the fourth determination method of FIG. 14.

FIG. 17 is a timing chart showing temporal changes of the first pressure P1, the second pressure P2, the first flow rate F1, and the second flow rate F2 when the piston 16 and the piston rod 18 are retracted in the direction of the arrow C in the double-shaft type cylinder 12 (see FIG. 5). Accordingly, the temporal change characteristics of the first pressure value P1 and the second pressure value P2 shown in FIG. 17 are the same as the temporal change characteristics of the first pressure value P1 and the second pressure value P2 shown in FIG. 9.

In addition, in the descriptions of the timing charts of FIGS. 15 to 17, descriptions of the first pressure value P1 and the second pressure value P2 will be simplified, and descriptions will be given primarily of the first flow rate F1 and the second flow rate F2.

In the case of advancing movement of the piston 16 in FIG. 15, the pressure fluid is supplied to the second cylinder chamber 22 at a time that the switching valve 32 of FIG. 2 is OFF (in the time zone before time t16), and the piston 16 is pressed toward the one end inside the cylinder body 14. On the other hand, the fluid of the first cylinder chamber 20 is discharged from the first tube 26 via the switching valve 32. Accordingly, in the time zone before time t16, the first pressure value P1 is approximately zero, and the second pressure value P2 is the pressure value Pv, together with the first flow rate F1, which is the flow rate of the pressure fluid in the first tube 26, and the second flow rate F2, which is the flow rate of the pressure fluid in the second tube 30, being substantially zero.

Next, at time t16, when a command signal is supplied from the microcomputer 62 of FIG. 3 to the solenoid 46, the switching valve 32 is driven and is turned ON. As a result, the connection state of the switching valve 32 is switched, and supply of the pressure fluid to the first cylinder chamber 20 is initiated, together with pressure fluid starting to be discharged from the second cylinder chamber 22.

Consequently, from time t16, the first pressure value P1 of the pressure fluid inside the first tube 26 increases abruptly with the passage of time, together with the first flow rate F1 (the rate at which the pressure fluid is supplied to the first cylinder chamber 20) increasing abruptly with the passage of time. On the other hand, the second pressure value P2 of the pressure fluid inside the second tube 30 decreases abruptly with the passage of time, together with the second flow rate F2 (the rate at which the pressure fluid is discharged from the second cylinder chamber 22) increasing abruptly with the passage of time.

Moreover, in the temporal change characteristics of the first flow rate F1 and the second flow rate F2 shown in FIGS. 15 to 17, it should be borne in mind that, in the case that the pressure fluid is supplied to the first cylinder chamber 20 or the second cylinder chamber 22, the sign of the flow rate of the supplied pressure fluid is positive, whereas in the case that the pressure fluid is discharged from the first cylinder chamber 20 or the second cylinder chamber 22, the sign of the flow rate of the supplied pressure fluid is negative.

In the case that the first pressure value P1 exceeds the second pressure value P2 at time t17, and at time t18, the first pressure value P1 rises to a predetermined pressure value (for example, the pressure value Pv) and the piston 16 starts to be advanced in the direction of the arrow D, the first flow rate F1 increases in the positive direction (the direction in which the pressure fluid is supplied to the first cylinder chamber 20) with the passage of time, whereas the second flow rate F2 increases in the negative direction (the direction in which the pressure fluid is discharged from the second cylinder chamber 22) with the passage of time.

Thereafter, during advancing movement of the piston 16, the first pressure value P1 drops from the pressure value Pv due to the change in volume of the first cylinder chamber 20, together with the second pressure value P2 also decreasing, whereby, in the case that the first pressure value P1 and the second pressure value P2 decrease while maintaining a substantially constant first differential pressure ΔP12, then after time t19, the first flow rate F1 and the second flow rate F2 become saturated and are maintained at a constant flow rate.

Thereafter, at time t20, when the piston 16 reaches the other end (first end) inside the cylinder body 14, the volume of the second cylinder chamber 22 becomes substantially zero. Consequently, after time t20, the second pressure value P2 decreases to substantially zero, together with the first pressure value P1 rising toward the pressure value Pv. In this case, the first flow rate F1 and the second flow rate F2 decrease to substantially zero from the predetermined flow rate. More specifically, when the piston 16 reaches the other end inside the cylinder body 14, the first differential pressure ΔP12 abruptly increases from a constant value, whereas the first flow rate difference ΔF12 between the first flow rate F1 and the second flow rate F2 (=F1−F2) decreases substantially to zero.

On the other hand, in the case of retracting movement of the piston 16 in FIG. 16, when the switching valve 32 of FIG. 2 is ON (in the time zone before time t21), the pressure fluid is supplied to the first cylinder chamber 20, and the piston 16 is pressed toward the other end inside the cylinder body 14. On the other hand, the fluid of the second cylinder chamber 22 is discharged from the second tube 30 via the switching valve 32. Accordingly, in the time zone before time t21, the first pressure value P1 is the pressure value Pv, and the second pressure value P2 is substantially zero, together with the first flow rate F1 and the second flow rate F2 being substantially zero.

Next, at time t21, when supply of the command signal from the microcomputer 62 of FIG. 3 to the solenoid 46 is stopped, the switching valve 32 stops being driven and is turned OFF. As a result, the connection state of the switching valve 32 is switched, and supply of the pressure fluid to the second cylinder chamber 22 is initiated, together with pressure fluid starting to be discharged from the first cylinder chamber 20.

Consequently, from time t21, the second pressure value P2 of the pressure fluid inside the second tube 30 increases abruptly with the passage of time, together with the second flow rate F2 (the rate at which the pressure fluid is supplied to the second cylinder chamber 22) increasing abruptly in the positive direction with the passage of time. On the other hand, the first pressure value P1 of the pressure fluid inside the first tube 26 decreases abruptly with the passage of time, together with the first flow rate F1 (the rate at which the pressure fluid is discharged from the first cylinder chamber 20) increasing abruptly in the negative direction with the passage of time.

Thereafter, at time t22, the second pressure value P2 exceeds the first pressure value P1, and the time t23, the second pressure value P2 rises to a predetermined pressure value (for example, the pressure value Pv), and the piston 16 starts to be retracted in the direction of the arrow C. During retracting movement of the piston 16, the second pressure value P2 drops from the pressure value Pv due to the change in volume of the second cylinder chamber 22, together with the first pressure value P1 also decreasing, whereby, in the case that the first pressure value P1 and the second pressure value P2 decrease while maintaining a substantially constant second differential pressure ΔP21, then after time t24, the first flow rate F1 and the second flow rate F2 become saturated and are maintained at a constant flow rate.

Thereafter, at time t25, when the piston 16 reaches the one end inside the cylinder body 14, the volume of the first cylinder chamber 20 becomes substantially zero. Consequently, after time t25, the first pressure value P1 decreases to substantially zero, together with the second pressure value P2 rising toward the pressure value Pv. In this case, the first flow rate F1 and the second flow rate F2 decrease to substantially zero from the predetermined flow rate. More specifically, when the piston 16 reaches the one end inside the cylinder body 14, the second differential pressure ΔP21 abruptly increases from a constant value, whereas the second flow rate difference ΔF21 between the second flow rate F2 and the first flow rate F1 (=F2−F1) decreases substantially to zero.

Further, even during retracting movement of the piston 16 in the double-shaft type cylinder 12 (refer to FIG. 5) of FIG. 17, similar to the retraction operation shown in FIG. 16, during the time at which the switching valve 32 of FIG. 2 is turned ON (in the time zone before time t26), the pressure fluid is supplied to the first cylinder chamber 20, and the piston 16 is pressed toward the other end inside the cylinder body 14. On the other hand, the fluid of the second cylinder chamber 22 is discharged from the second tube 30 via the switching valve 32. Accordingly, in the time zone before time t26, the first pressure value P1 is the pressure value Pv, and the second pressure value P2 is substantially zero, together with the first flow rate F1 and the second flow rate F2 being substantially zero.

Next, at time t26, when supply of the command signal from the microcomputer 62 of FIG. 3 to the solenoid 46 is stopped, the switching valve 32 stops being driven and is turned OFF. As a result, the connection state of the switching valve 32 is switched, and supply of the pressure fluid to the second cylinder chamber 22 is initiated, together with pressure fluid starting to be discharged from the first cylinder chamber 20.

Consequently, from time t26, the second pressure value P2 of the pressure fluid inside the second tube 30 increases abruptly with the passage of time, together with the second flow rate F2 increasing abruptly in the positive direction with the passage of time. On the other hand, the first pressure value P1 of the pressure fluid inside the first tube 26 decreases abruptly with the passage of time, together with the first flow rate F1 increasing abruptly in the negative direction with the passage of time.

Thereafter, at time t27, the second pressure value P2 exceeds the first pressure value P1, and at time t28, the second pressure value P2 rises to a predetermined pressure value (for example, a pressure value in the vicinity of the pressure value Pv), and the piston 16 starts to be retracted in the direction of the arrow C. During retracting movement of the piston 16, the second pressure value P2 drops from the pressure value Pv due to the change in volume of the second cylinder chamber 22, together with the first pressure value P1 also decreasing, whereby, in the case that the first pressure value P1 and the second pressure value P2 decrease while maintaining a substantially constant second differential pressure ΔP21, then after time t29, the first flow rate F1 and the second flow rate F2 become saturated and are maintained at a constant flow rate.

Thereafter, at time t30, when the piston 16 reaches the one end inside the cylinder body 14, the volume of the first cylinder chamber 20 becomes substantially zero. Consequently, after time t30, the first pressure value P1 decreases to substantially zero, together with the second pressure value P2 rising toward the pressure value Pv. In this case, the first flow rate F1 and the second flow rate F2 decrease to substantially zero from the predetermined flow rate. More specifically, when the piston 16 reaches the one end inside the cylinder body 14, the second differential pressure ΔP21 abruptly increases from a constant value, whereas the second flow rate difference ΔF21 between the second flow rate F2 and the first flow rate F1 decreases substantially to zero.

Moreover, concerning the time of advancing movement of the piston 16 in the double-shaft type cylinder 12, by replacing a temporal change characteristic of the first pressure value P1 of FIG. 17 with a characteristic of the second pressure value P2, replacing a temporal change characteristic of the second pressure value P2 with the first pressure value P1, replacing the second differential pressure ΔP21 with the first differential pressure ΔP12, replacing the first flow rate F1 with the second flow rate F2, replacing the second flow rate F2 with the first flow rate F1, and replacing the second flow rate difference ΔF21 with the first flow rate difference ΔF12, it is possible to obtain a temporal change characteristic at a time of advancing movement.

Thus, in the fourth determination method, in addition to the features of the first and second determination methods, by grasping the decrease in the first flow rate difference ΔF12 or the second flow rate difference ΔF21 after times t20, t25, and t30, the reliability of the determination process as to whether or not the piston 16 has reached the one end or the other end inside the cylinder body 14 is further improved.

More specifically, the first pressure value P1 detected by the first pressure sensor 50, the second pressure value P2 detected by the second pressure sensor 52, the first flow rate F1 detected by the first flow rate sensor 56, and the second flow rate F2 detected by the second flow rate sensor 58 of FIG. 2 are sequentially input to the microcomputer 62 via the input/output interface 60 of FIG. 3. Thus, each time the first pressure value P1, the second pressure value P2, the first flow rate F1, and the second flow rate F2 are input, the microcomputer 62 executes the determination process in accordance with the fourth determination method shown in FIG. 14.

Figure 14:
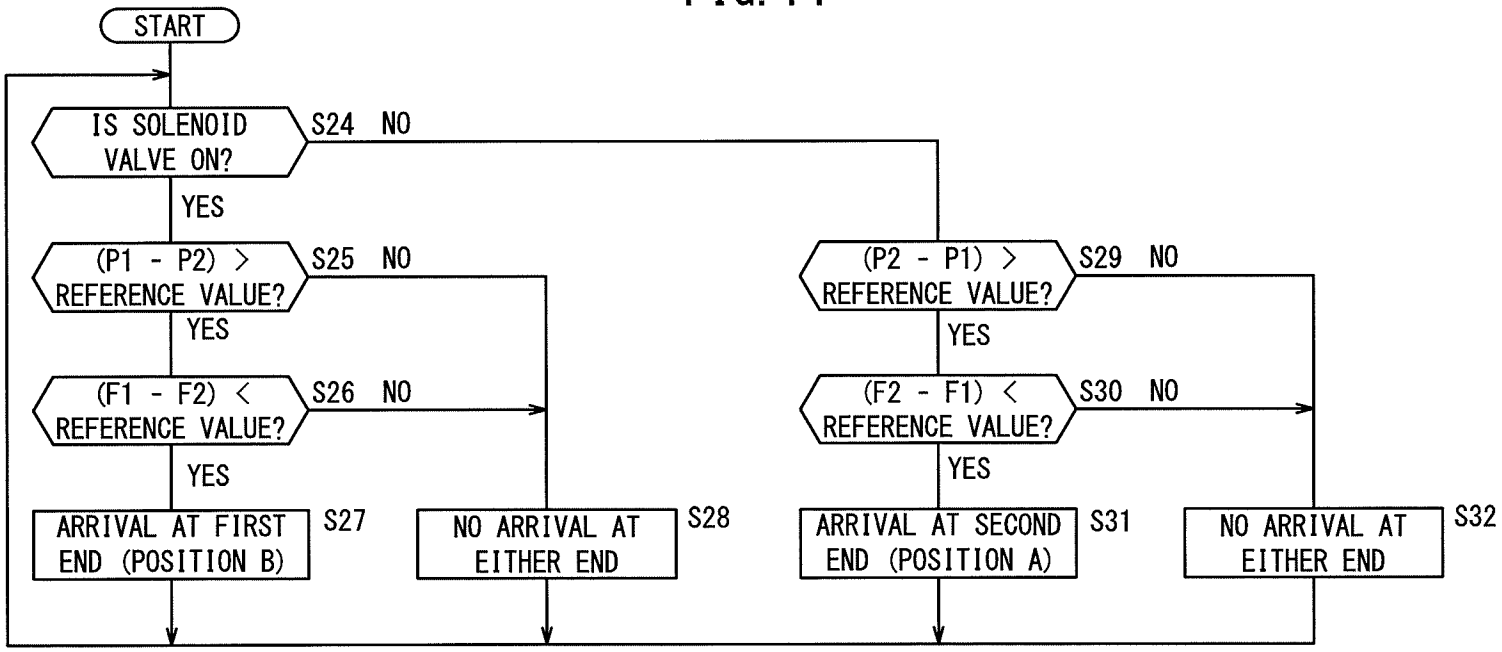
FIG. 14 is a flowchart illustrating a fourth determination method of the present embodiment.

More specifically, in step S24 of FIG. 14, the microcomputer 62 of FIG. 3 determines whether or not the switching valve 32 is ON, in the same manner as in step S6 of FIG. 10 and step S13 of FIG. 11.

In the case that the switching valve 32 is ON (step S24: YES), by the pressure fluid being supplied to the first cylinder chamber 20 from the fluid supply source 42, the microcomputer 62 determines that the piston 16 is undergoing advancing movement.

Next, in the following step S25, the microcomputer 62 calculates the first differential pressure ΔP12 in the same manner as in step S1 of FIG. 6, step S7 of FIG. 10, and step S14 of FIG. 11, and determines whether or not the calculated first differential pressure ΔP12 exceeds the first reference differential pressure ΔP12ref.

In the case that ΔP12>ΔP12ref (step S25: YES), the microcomputer 62 determines that there is a possibility that the piston 16 will reach the other end inside the cylinder body 14 (that the piston rod 18 will reach the position B). In addition, in the following step S26, the microcomputer 62 calculates the first flow rate difference ΔF12 by subtracting the second flow rate F2 from the first flow rate F1, and it is determined whether or not the calculated first flow rate difference ΔF12 is less than the first reference flow rate difference ΔF12ref as a reference value that is stored in advance in the memory unit 68.

In the case that ΔF12<ΔF12ref (step S26: YES), then in the following step S27, the microcomputer 62 determines that the piston 16 has reached the other end inside the cylinder body 14 (the piston rod 18 has reached the position B) due to the advancing movement thereof. In addition, the microcomputer 62 outputs the first end signal to the exterior via the input/output interface 60, together with displaying the above-described determination result on the display unit 66, and notifying the user that the piston 16 has arrived at the first end.

On the other hand, in the case that ΔF12≥ΔF12ref (step S26: NO), then in step S28, the microcomputer 62 determines that the piston 16, although advancing along the direction of the arrow D, has not reached the other end inside the cylinder body 14. Further, in step S25, in the case that ΔP12≤ΔP12ref (step S25: NO), the microcomputer 62 performs the process of step S28, and determines that the piston 16 has not reached the other end inside the cylinder body 14.

In the above-described step S24, in the case that the switching valve 32 is OFF (step S24: NO), then by the pressure fluid being supplied to the second cylinder chamber 22 from the fluid supply source 42, the microcomputer 62 determines that the piston 16 is undergoing retracting movement from the other end toward the one end inside the cylinder body 14.

In addition, in the following step S29, the microcomputer 62 calculates the second differential pressure ΔP21 in the same manner as in step S3 of FIG. 6, step S10 of FIG. 10, and step S19 of FIG. 11, and determines whether or not the calculated second differential pressure ΔP21 exceeds the second reference differential pressure ΔP21ref.

In the case that ΔP21>ΔP21ref (step S29: YES), the microcomputer 62 determines that there is a possibility that the piston 16 will reach the one end inside the cylinder body 14 (that the piston rod 18 will reach the position A). In addition, in the following step S30, the microcomputer 62 calculates the second flow rate difference ΔF21 by subtracting the first flow rate F1 from the second flow rate F2, and it is determined whether or not the calculated second flow rate difference ΔF21 is less than the second reference flow rate difference ΔF21ref as a reference value that is stored in advance in the memory unit 68.

In the case that ΔF21<ΔF21ref (step S30: YES), then in the following step S31, the microcomputer 62 determines that the piston 16 has reached the one end inside the cylinder body 14 (the piston rod 18 has reached the position A) due to the retracting movement thereof. In addition, the microcomputer 62 outputs the second end signal to the exterior via the input/output interface 60, together with displaying the above-described determination result on the display unit 66, and notifying the user that the piston 16 has arrived at the second end.

On the other hand, in the case that ΔF21≥ΔF21ref (step S30: NO), then in step S32, the microcomputer 62 determines that the piston 16, although being retracted along the direction of the arrow C, has not reached the one end inside the cylinder body 14. Further, in step S29, in the case that ΔP21≤ΔP21ref (step S29: NO), the microcomputer 62 performs the process of step S32, and determines that the piston 16 has not reached the one end inside the cylinder body 14.

In this manner, in the fourth determination method, since the determination process using the first flow rate F1 and the second flow rate F2 is also performed in addition to the first and second determination methods, it is possible to reliably determine the arrival of the piston 16 at one end or the other end inside the cylinder body 14.

2.5. Fifth Determination Method

In the fifth determination method, by partially changing the fourth determination method of FIGS. 14 to 17, an abnormality determination process on the piston 16 is performed which is similar to the third determination method. In the fifth determination method, on the basis of the first integral flow rate Q1, which is an integrated amount of the first flow rate F1 (a total flow rate within a predetermined time period), and the second integral flow rate Q2, which is an integrated amount of the second flow rate F2, the presence or absence of an operation abnormality of the piston 16 is determined.

Figure 18:
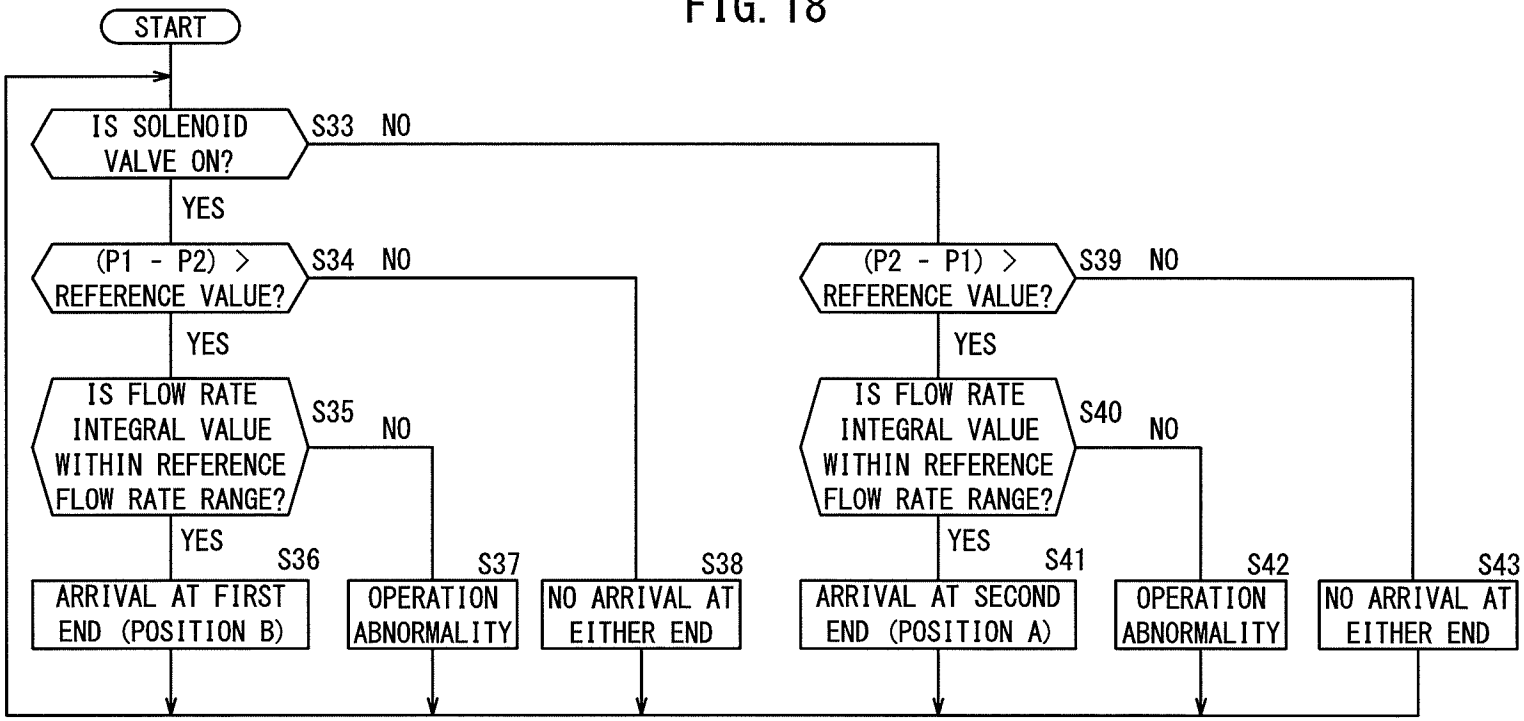
FIG. 18 is a flowchart illustrating a fifth determination method of the present embodiment.

More specifically, in step S33 of FIG. 18, the microcomputer 62 of FIG. 3 determines whether or not the switching valve 32 is ON, in the same manner as in step S6 of FIG. 10, step S13 of FIG. 11, and step S24 of FIG. 14.

In the case that the switching valve 32 is ON (step S33: YES), by the pressure fluid being supplied to the first cylinder chamber 20 from the fluid supply source 42, the microcomputer 62 determines that the piston 16 is undergoing advancing movement.

Next, in the following step S34, the microcomputer 62 calculates the first differential pressure ΔP12 in the same manner as in step S1 of FIG. 6, step S7 of FIG. 10, step S14 of FIG. 11, and step S25 of FIG. 14, and determines whether or not the calculated first differential pressure ΔP12 exceeds the first reference differential pressure ΔP12ref.

In the case that ΔP12>ΔP12ref (step S34: YES), the microcomputer 62 determines that there is a possibility that the piston 16 will reach the other end inside the cylinder body 14 (that the piston rod 18 will reach the position B).

In the following step S35, the microcomputer 62 carries out an integration process of the first flow rate F1 from the point in time of the switching valve 32 being turned ON to the present point in time, and calculates the integrated amount thereof as the first integral flow rate Q1. For example, the microcomputer 62 calculates the first integral flow rate Q1 by performing the integration process of the first flow rate F1 from the point in time t16 to the point in time t20 shown in FIG. 15. In addition, the microcomputer 62 determines whether or not the first integral flow rate Q1 lies within the reference flow rate range Qref that was previously stored in the memory unit 68.

In the case that the first integral flow rate Q1 lies within the reference flow rate range Qref (step S35: YES), then in the following step S36, the microcomputer 62 determines that the piston 16 has reached the other end inside the cylinder body 14 (the piston rod 18 has reached the position B) due to the normal advancing movement thereof. In addition, the microcomputer 62 outputs the first end signal to the exterior via the input/output interface 60, together with displaying the above-described determination result on the display unit 66, and notifying the user that the piston 16 has arrived normally at the first end.

On the other hand, in the case that the first integral flow rate Q1 deviates from the reference flow rate range Qref (step S35: NO), then in step S37, the microcomputer 62 determines that operation of the piston 16 is abnormal, and warns the user by displaying the determination result on the display unit 66.

Further, in step S34, in the case that ΔP12≤ΔP12ref (step S34: NO), then in step S38, the microcomputer 62 determines that the piston 16, although advancing along the direction of the arrow D, has not reached the other end inside the cylinder body 14.

In the above-described step S33, in the case that the switching valve 32 is OFF (step S33: NO), then by the pressure fluid being supplied to the second cylinder chamber 22, the microcomputer 62 determines that the piston 16 is undergoing retracting movement from the other end toward the one end inside the cylinder body 14.

In addition, in the following step S39, the microcomputer 62 calculates the second differential pressure ΔP21 in the same manner as in step S3 of FIG. 6, step S10 of FIG. 10, step S19 of FIG. 11, and step S29 of FIG. 14, and determines whether or not the calculated second differential pressure ΔP21 exceeds the second reference differential pressure ΔP21ref.

In the case that ΔP21>ΔP21ref (step S39: YES), the microcomputer 62 determines that there is a possibility that the piston 16 will reach the one end inside the cylinder body 14 (that the piston rod 18 will reach the position A).

In the following step S40, the microcomputer 62 carries out an integration process of the second flow rate F2 from the point in time of the switching valve 32 being turned OFF to the present point in time, and calculates the integrated amount thereof as the second integral flow rate Q2. For example, the microcomputer 62 calculates the second integral flow rate Q2 by performing the integration process of the second flow rate F2 from the point in time t21 to the point in time t25 shown in FIG. 16, or from the point in time t26 to the point in time point t30 shown in FIG. 17. In addition, the microcomputer 62 determines whether or not the second integral flow rate Q2 lies within the reference flow rate range Qref.

In the case that the second integral flow rate Q2 lies within the reference flow rate range Qref (step S40: YES), then in the following step S41, the microcomputer 62 determines that the piston 16 has reached the one end inside the cylinder body 14 (the piston rod 18 has reached the position A) due to the normal retracting movement thereof. In addition, the microcomputer 62 outputs the second end signal to the exterior via the input/output interface 60, together with displaying the above-described determination result on the display unit 66, and notifying the user that the piston 16 has arrived normally at the second end.

On the other hand, in the case that the second integral flow rate Q2 deviates from the reference flow rate range Qref (step S40: NO), then in step S42, the microcomputer 62 determines that operation of the piston 16 is abnormal, and warns the user by displaying the determination result on the display unit 66.

Further, in step S39, in the case that $\Delta P21 \leq \Delta P21ref$ (step S39: NO), then in step S43, the microcomputer 62 determines that the piston 16, although being retracted along the direction of the arrow C, has not reached the one end inside the cylinder body 14.

In the foregoing manner, in the fifth determination method, since the determination process of the first integral flow rate Q1 and the second integral flow rate Q2 is also performed, it is possible to detect the presence or absence of an abnormality in the movement operation of the piston 16.

3. Effects of the Present Embodiment

As described above, according to the monitoring device 10 of the present embodiment, by supplying the pressure fluid from the fluid supply source 42 to the first cylinder chamber 20 or the second cylinder chamber 22 via the first tube 26 or the second tube 30, the piston 16 and the piston rod 18 are capable of moving reciprocally between the one end and the other end inside the cylinder body 14. More specifically, the piston 16 and the piston rod 18 undergo reciprocal movement in accordance with a change (increase or decrease of pressure) in the pressures of the first cylinder chamber 20 and the second cylinder chamber 22 in accordance with a supplying operation of the pressure fluid.

In this case, when the piston 16 has reached the one end inside the cylinder body 14, the pressure fluid in the first cylinder chamber 20 is discharged to the exterior, whereas the pressure in the second cylinder chamber 22 becomes the pressure of the pressure fluid that is supplied via the second tube 30. Further, when the piston 16 has reached the other end inside the cylinder body 14, the pressure in the first cylinder chamber 20 becomes the pressure of the pressure fluid that is supplied via the first tube 26, whereas the pressure fluid in the second cylinder chamber 22 is discharged to the exterior.

In addition, the first pressure value P1 of the pressure fluid inside the first tube 26 corresponding to the pressure of the first cylinder chamber 20 is detected by the first pressure sensor 50, while on the other hand, the second pressure value P2 of the pressure fluid inside the second tube 30 corresponding to the pressure of the second cylinder chamber 22 is detected by the second pressure sensor 52. Accordingly, it is possible to easily monitor the first pressure value P1 and the second pressure value P2.

Thus, in the monitoring device 10 according to the present embodiment, on the basis of the first pressure value P1 of the pressure fluid inside the first tube 26 detected by the first pressure sensor 50, and the second pressure value P2 of the pressure fluid inside the second tube 30 detected by the second pressure sensor 52, it is determined whether or not the piston 16 has reached the one end or the other end inside the cylinder body 14.

Consequently, without installing a sensor in the vicinity of the cylinder 12, it is possible to detect the arrival of the piston 16 at the one end or the other end inside the cylinder body 14. Further, because there is no need to install a sensor and wiring for the sensor in the vicinity of the cylinder 12, there is no occurrence of problems such as corrosion of the sensor and wiring therefor in a cleaning process used in connection with food related equipment. As a result, the cylinder 12 can be suitably used in connection with food related equipment.

More specifically, in the case that the piston 16 moves reciprocally between the one end and the other end inside the cylinder body 14, the first differential pressure $\Delta P12$ or the second differential pressure $\Delta P21$ is maintained at a substantially constant value. Additionally, when the piston 16 reaches the one end or the other end inside the cylinder body 14, since the pressure in one of the chambers from among the first cylinder chamber 20 and the second cylinder chamber 22 becomes the pressure (the pressure value Pv) of the supplied pressure fluid, whereas the pressure in the other chamber drops to substantially zero, the first differential pressure $\Delta P12$ or the second differential pressure $\Delta P21$ increases abruptly. Thus, by grasping such a change in the first differential pressure $\Delta P12$ or the second differential pressure $\Delta P21$, the microcomputer 62 of the detector 54 can easily detect the arrival of the piston 16 at the one end or the other end inside the cylinder body 14.

In this case, by grasping an abrupt increase in the first differential pressure $\Delta P12$ or the second differential pressure $\Delta P21$, it is possible for the microcomputer 62 to determine whether the piston 16 has reached the one end or the other end inside the cylinder body 14, and together therewith, by specifying the sign (positive or negative) of the first differential pressure $\Delta P12$ or the second differential pressure $\Delta P21$ at that time, to recognize which of the one end or the other end inside the cylinder body 14 that the piston 16 has reached.

Further, in the first determination method, at a time that the first differential pressure $\Delta P12$ has exceeded the first reference differential pressure $\Delta P12ref$, it is determined that the piston 16 has reached the other end inside the cylinder body 14. Further, at a time that the second differential pressure $\Delta P21$ has exceeded the second reference differential pressure $\Delta P21ref$, it is determined that the piston 16 has reached the one end inside the cylinder body 14. Furthermore, in the case that the first differential pressure $\Delta P12$ is less than or equal to the first reference differential pressure $\Delta P12ref$, and the second differential pressure $\Delta P21$ is less than or equal to the second reference differential pressure ΔP21ref, it is determined that the piston 16 is between the one end and the other end inside the cylinder body 14.

In accordance with this feature, based only on the first differential pressure ΔP12 and the second differential pressure ΔP21, it can easily be determined that the piston 16 has reached the one end or the other end inside the cylinder body 14.

Further, in the first determination method, as shown in FIG. 4, in the case that the presence or absence of the arrival of the piston 16 at the one end or the other end inside the cylinder body 14 is determined by an analog signal processing method, the detector 54 is constituted by the operational amplifier circuits 72 to 78, and is configured to be capable of adjusting the reference voltage V12ref or V21ref in accordance with the first reference differential pressure ΔP12ref or the second reference differential pressure ΔP21ref. In accordance with this feature, on the basis of a comparison between the output signals based on the first pressure value P1 and the second pressure value P2 and the reference voltages V12ref and V21ref, it can easily be determined whether or not the piston 16 has reached the one end or the other end inside the cylinder body 14.

Further, the operating characteristics of the cylinder (temporal change characteristics of the first pressure value P1 and the second pressure value P2) differ in accordance with the operating environment of the cylinder 12 and the type of the cylinder 12. Thus, by making the reference voltage V12ref or the reference voltage V21ref adjustable, it is possible to detect the arrival of the piston 16 at the one end or the other end inside the cylinder body 14 while setting appropriate specifications in accordance with the user's request.

According to the second determination method, by understanding through which one of the first tube 26 and the second tube 30 the switching valve 32 is connected to the fluid supply source 42, the movement direction of the piston 16 inside the cylinder body 14 can be specified. Thus, according to the second determination method, the movement direction of the piston 16 inside the cylinder body 14 is specified on the basis of the connected relationship between the fluid supply source 42 and the first tube 26 or the second tube 30 by the switching valve 32, and concerning the specified movement direction, it is determined whether or not the piston 16 has reached the one end or the other end inside the cylinder body 14 on the basis of a comparison between the first differential pressure P12 or the second differential pressure P21 and the first reference differential pressure ΔP12ref or the second reference differential pressure ΔP21ref. Consequently, it is possible to efficiently and reliably detect the arrival of the piston 16 at the one end or the other end inside the cylinder body 14.

In particular, in the double-shaft type cylinder 12 of FIG. 5, in comparison with the single-shaft type cylinder 12 of FIGS. 1 and 2, the piston areas on both side surfaces of the piston 16 are substantially the same, and the first differential pressure ΔP12 and the second differential pressure ΔP21 are made small. Accordingly, by specifying the movement direction of the piston 16 in accordance with the second determination method, it is possible to improve the reliability of the above-described determination process.

Further, even in the case that the piston 16 is located between the one end and the other end inside the cylinder body 14 due to an abnormal condition such as a case in which the distal end of the piston rod 18 collides with the obstacle 82, a case in which the setting of the first reference differential pressure ΔP12ref or the second reference differential pressure ΔP21ref is changed, or alternatively, a case in which fluid is leaking from the cylinder 12, the first tube 26, or the second tube 30, there is a possibility that the first differential pressure ΔP12 or the second differential pressure ΔP21 may exceed the first reference differential pressure ΔP12ref or the second reference differential pressure ΔP21ref, and that the arrival of the piston 16 at the one end or the other end may be erroneously detected. Further, in the aforementioned abnormal conditions, there may be a case in which the arrival time period (stroke time T) of the piston 16 at the one end or the other end inside the cylinder body 14 is shorter (the stroke time T2) or is longer (the stroke time T3) in comparison with the arrival time period (stroke time T1) thereof in the normal state. Therefore, such abnormal conditions are difficult to detect merely by comparing the first differential pressure ΔP12 or the second differential pressure ΔP21 with the first reference differential pressure ΔP12ref or the second reference differential pressure ΔP21ref.

Thus, according to the third determination method, if the time period (stroke time T) measured by the timer 70 lies within the reference time range Tref, the cylinder 12, etc., is in a normal state, and by the piston 16 and the piston rod 18 carrying out the reciprocal movement operation in a normal manner, it is determined that the piston 16 has reached the one end or the other end inside the cylinder body 14. On the other hand, if the stroke time T deviates from the reference time range Tref, it is determined that the cylinder 12, etc., is in an abnormal state, and the reciprocal movement operation of the piston 16 and the piston rod 18 is abnormal. Consequently, it is possible to easily detect an abnormality of the cylinder 12 or the like, as well as an abnormality in the reciprocal movement operation of the piston 16 and the piston rod 18.

As the fourth determination method, in addition to the comparison between the first differential pressure ΔP12 or the second differential pressure ΔP21 and the first reference differential pressure ΔP12ref or the second reference differential pressure ΔP21ref, the microcomputer 62 compares the first flow rate difference ΔF12 or the second flow rate difference ΔF21 with the first reference flow rate difference ΔF12ref or the second reference flow rate difference ΔF21ref. Consequently, the reliability of the determination result in relation to the arrival of the piston 16 at the one end or the other end inside the cylinder body 14 can be improved.

In the fifth determination method, by calculating the first integral flow rate Q1 or the second integral flow rate Q2, it is possible to estimate the operation stroke until the piston 16 reaches the one end or the other end inside the cylinder body 14. Consequently, the distance that the piston 16 moves can be specified.

Further, in the third or the fifth determination method described above, in the case that the microcomputer 62 determines that the reciprocal motion operation of the piston 16 and the piston rod 18 is abnormal, the monitoring device 10 further includes the display unit 66 that displays a notification of the determination result to the exterior. In accordance with this feature, it is possible to notify the user of the occurrence of an abnormal state.

Further, in the above-described first to fifth determination methods, by determining the presence or absence of the arrival of the piston 16 at the one end or the other end inside the cylinder body 14 by digital signal processing using the microcomputer 62, it is possible to more easily set the reference values, such as the first reference differential pressure ΔP12ref and the second reference differential pressure ΔP21ref, in comparison with a case in which the detector 54 is configured by an analog circuit. Further, by setting the reference values (operating conditions) in advance in accordance with operations of a normal cylinder 12, since teaching is performed with respect to the monitoring device 10, detection of an abnormal state or the like becomes easy to perform.

4. Modifications

In the monitoring device 10 according to the present embodiment, as an application of the cylinder 12, it is possible to perform an operation in which the distal ends of the piston rods 18, 80 are pressed against an object, or an object is grasped (clamped) at the distal ends of the piston rods 18, 80.

In this case, in the event that the size (work size) of the object is known, a non-illustrated sensor may be provided beforehand in the vicinity of the position (pressing position, gripping position) where the distal ends of the piston rods 18, 80 are stopped by operation of the cylinder 12, whereby it is possible to recognize the completion of work on the object, and proceed to a subsequent process step, on the basis of the detection result of the sensor.

On the other hand, in the case that the size of the object frequently differs, the stopped position of the distal end parts of the piston rods 18, 80 also differ depending on the size of the object, and therefore, the determination process of completion of operations using the sensor becomes difficult to perform. Even with respect to such an application, with the monitoring device 10 according to the present embodiment, by using the aforementioned first, second, fourth, and fifth determination methods (see FIGS. 6 to 10 and FIGS. 14 to 18), it is possible to easily determine the completion of operations on the object, and proceed to the next process step.

The present invention is not limited to the above-described embodiments, and it is a matter of course that various configurations could be adopted therein without departing from the essence and gist of the present invention.

The invention claimed is:

1. An operation state monitoring device for a cylinder in which a piston connected to a piston rod is reciprocally moved between one end and another end inside a cylinder body, by a first cylinder chamber being formed between the one end and the piston inside the cylinder body, together with a second cylinder chamber being formed between the other end and the piston inside the cylinder body, and by a fluid being supplied from a fluid supply source to the first cylinder chamber via a first tube, or the fluid being supplied from the fluid supply source to the second cylinder chamber via a second tube, the operation state monitoring device for the cylinder comprising:

a first pressure detecting unit configured to detect a pressure of the fluid inside the first tube;

a second pressure detecting unit configured to detect a pressure of the fluid inside the second tube; and a determination unit configured to determine which of the one end and the other end inside the cylinder body that the piston has reached, on a basis of a differential pressure between a first pressure value which is a pressure value of the fluid inside the first tube detected by the first pressure detecting unit and a second pressure value which is a pressure value of the fluid inside the second tube detected by the second pressure detecting unit, and a sign of the differential pressure.

2. The operation state monitoring device for the cylinder according to claim 1, wherein the determination unit is configured to:

determine that the piston has reached the other end inside the cylinder body, when a first differential pressure, which is obtained by subtracting the second pressure value from the first pressure value, exceeds a first reference differential pressure;

determine that the piston has reached the one end inside the cylinder body, when a second differential pressure, which is obtained by subtracting the first pressure value from the second pressure value, exceeds a second reference differential pressure; and determine that the piston is between the one end and the other end inside the cylinder body, in a case that the first differential pressure is less than or equal to the first reference differential pressure, and the second differential pressure is less than or equal to the second reference differential pressure.

3. The operation state monitoring device for the cylinder according to claim 2, wherein:

the first pressure detecting unit is configured to output to the determination unit a first pressure signal corresponding to the first pressure value;

the second pressure detecting unit is configured to output to the determination unit a second pressure signal corresponding to the second pressure value; and the determination unit includes a comparison circuit, is configured to adjust a reference voltage in accordance with the first reference differential pressure or the second reference differential pressure, and determine whether or not the piston has reached the one end or the other end inside the cylinder body by comparing a signal level difference between the input first pressure signal and the input second pressure signal with the reference voltage.

4. The operation state monitoring device for the cylinder according to claim 2, further comprising:

a reference value setting unit configured to set at least the first reference differential pressure and the second reference differential pressure;

a display unit configured to display at least the first reference differential pressure and the second reference differential pressure that were set; and a storage unit configured to store at least the first reference differential pressure and the second reference differential pressure that were set;

wherein the first pressure detecting unit is configured to output a first pressure signal corresponding to the first pressure value to the determination unit;

the second pressure detecting unit is configured to output a second pressure signal corresponding to the second pressure value to the determination unit; and the determination unit is configured to include a microcomputer, and using the first pressure value and the second pressure value in accordance with the input first pressure signal and the input second pressure signal, and the first reference differential pressure and the second reference differential pressure that were set, the determination unit is configured to determine whether or not the piston has reached the one end or the other end inside the cylinder body.

5. The operation state monitoring device for the cylinder according to claim 1, further comprising a switching valve configured to switch a connection between the fluid supply source and the first tube or the second tube, and a control unit configured to drive the switching valve by supplying a command signal to the switching valve to thereby switch the connection;

wherein the determination unit is configured to:

in a case that the fluid supply source and the first tube are connected via the switching valve, determine that the piston has reached the other end inside the cylinder body when the first differential pressure, which is obtained by subtracting the second pressure value from the first pressure value, exceeds the first reference differential pressure, whereas if the first differential pressure is less than or equal to the first reference differential pressure, determine that the piston is between the one end and the other end inside the cylinder body; and in a case that the fluid supply source and the second tube are connected via the switching valve, determine that the piston has reached the one end inside the cylinder body when the second differential pressure, which is obtained by subtracting the first pressure value from the second pressure value, exceeds the second reference differential pressure, whereas if the second differential pressure is less than or equal to the second reference differential pressure, determine that the piston is between the one end and the other end inside the cylinder body.

6. The operation state monitoring device for the cylinder according to claim 5, further comprising a time measuring unit configured to measure time from a time at which the control unit begins to supply the command signal to the switching valve;

wherein the determination unit is configured to, in a case that the first differential pressure exceeds the first reference differential pressure or the second differential pressure exceeds the second reference differential pressure, and if a measured time of the time measuring unit lies within a reference time range, determine that the piston has reached the one end or the other end inside the cylinder body, whereas if the measured time deviates from the reference time range, determine that the reciprocal motion operation of the piston and the piston rod is abnormal.

7. The operation state monitoring device for the cylinder according to claim 6, further comprising a notification unit configured to issue a notification of a determination result to exterior, in a case that the determination unit determines that the reciprocal motion of the piston and the piston rod is abnormal.

8. The operation state monitoring device for the cylinder according to claim 5, further comprising a first flow rate detecting unit configured to detect a flow rate of the fluid inside the first tube as a first flow rate, and a second flow rate detecting unit configured to detect a flow rate of the fluid inside the second tube as a second flow rate;

wherein the determination unit is configured to:

in a case that the first differential pressure exceeds the first reference differential pressure, and if a first flow rate difference, which is obtained by subtracting the second flow rate from the first flow rate, is less than a first reference flow rate difference, determine that the piston has reached the other end inside the cylinder body, whereas if the first flow rate difference is greater than or equal to the first reference flow rate difference, determine that the piston is between the one end and the other end inside the cylinder body; and in a case that the second differential pressure exceeds the second reference differential pressure, and if a second flow rate difference, which is obtained by subtracting the first flow rate from the second flow rate, is less than a second reference flow rate difference, determine that the piston has reached the one end inside the cylinder body, whereas if the second flow rate difference is greater than or equal to the second reference flow rate difference, determine that the piston is between the one end and the other end inside the cylinder body.

9. The operation state monitoring device for the cylinder according to claim 5, further comprising a first flow rate detecting unit configured to detect a flow rate of the fluid inside the first tube as a first flow rate, a second flow rate detecting unit configured to detect a flow rate of the fluid inside the second tube as a second flow rate, and an integral flow rate calculating unit configured to calculate a first integral flow rate by integrating the first flow rate, or to calculate a second integral flow rate by integrating the second flow rate;

wherein the determination unit is configured to, in a case that the first differential pressure exceeds the first reference differential pressure or the second differential pressure exceeds the second reference differential pressure, and if the first integral flow rate or the second integral flow rate lies within a reference flow rate range, determine that the piston has reached the one end or the other end inside the cylinder body, whereas if the first integral flow rate or the second integral flow rate deviates from the reference flow rate range determine that a reciprocal motion operation of the piston and the piston rod is abnormal.

10. The operation state monitoring device for the cylinder according to claim 5, wherein the switching valve is a single acting or double acting type of solenoid valve.

11. The operation state monitoring device for the cylinder according to claim 1, further comprising an input/output unit configured to input to the determination unit the respective pressures detected by at least the first pressure detecting unit and the second pressure detecting unit, and to output to exterior a determination result of the determination unit.

12. The operation state monitoring device for the cylinder according to claim 1, wherein the cylinder is a single-shaft type cylinder in which the piston rod is integrally connected to the piston on a side of the first cylinder chamber or on a side of the second cylinder chamber, or alternatively, is a double-shaft type cylinder in which piston rods are integrally connected to the piston respectively on the side of the first cylinder chamber and on the side of the second cylinder chamber.

* * * * *